US005732565A

United States Patent [19]

Ramakrishnan et al.

[11] Patent Number: 5,732,565

[45] **Date of Patent: *Mar. 31, 1998**

[54] MODULAR ROOM AIR CONDITIONER

[75] Inventors: Rengaswamy Ramakrishnan; Eric H. Albrecht, both of San Antonio; Gerald C. Smith, Canyon Lake; Roger D. Conatser, San Antonio, all of Tex.

[73] Assignee: U.S. Natural Resources, Inc., San Antonio, Tex.

[ * ] Notice: The term of this patent shall not extend beyond the expiration date of Pat. No. 5,622,058.

[21] Appl. No.: 794,426

[22] Filed: Feb. 5, 1997

Related U.S. Application Data

[62] Division of Ser. No. 475,484, Jun. 7, 1995, Pat. No. 5,622,058.

[51] Int. Cl.[6] ..... F25D 19/00

[52] U.S. Cl. ..... 62/298; 62/277

[58] Field of Search ..... 62/295, 298, 77, 62/262, 296, 297, 259.1, 427, 277

[56] References Cited

U.S. PATENT DOCUMENTS

| | | | |
|---|---|---|---|
| 2,885,142 | 5/1959 | Eberhart | 62/262 |
| 2,891,389 | 6/1959 | Tull | 62/298 |
| 3,636,724 | 1/1972 | Moy | 62/215 |
| 3,756,039 | 9/1973 | Riello | 62/262 |
| 3,838,579 | 10/1974 | Ballard | 62/262 |
| 4,172,697 | 10/1979 | Schoen | 417/372 |
| 4,223,503 | 9/1980 | Hague | 52/262 |
| 4,346,568 | 8/1982 | Perrone et al. | 62/262 |
| 4,637,223 | 1/1987 | Hosoya et al. | 62/263 |
| 4,977,750 | 12/1990 | Metcalfe | 62/298 |
| 5,085,057 | 2/1992 | Thompson et al. | 62/262 |
| 5,193,355 | 3/1993 | Matsumi | 62/262 |
| 5,203,400 | 4/1993 | Tsunekawa et al. | 165/59 |
| 5,415,011 | 5/1995 | Gilmore et al. | 62/262 |
| 5,437,164 | 8/1995 | Consiglio | 62/259.1 |
| 5,622,058 | 4/1997 | Ramakrishnan et al. | 62/295 |

*Primary Examiner*—William Doerrler

[57] ABSTRACT

An air conditioning unit comprising a refrigeration assembly, an air handling assembly, and a control assembly. The refrigeration assembly includes a generally rectangular base pan having upturned edges and a floor having a raised section, the base pan having a condenser, an evaporator, and a compressor mounted to an upper surface thereof. The air handling assembly includes a bulkhead having adjacent side wall portions, a scroll, a motor having an output shaft, a motor mount bracket for engaging the base pan of the refrigeration assembly, a fan, and a blower engaging the output shaft of the motor, a fan shroud and struts for mounting the shroud to the bulkhead and an air plenum assembly. The control assembly includes a control housing and a control panel.

27 Claims, 18 Drawing Sheets

MODULAR ROOM AIR CONDITIONER

This is a continuation of application Ser. No. 08/475,484 filed Jun. 7, 1995, now U.S. Pat. No. 5,622,058.

FIELD OF THE INVENTION

A room air conditioner constructed from preassembled modules, including a refrigerant module, an air-handling module, and a control module, the modules featuring a number of unique features allowing quiet and efficient operation of the room air conditioner, as well as for ease of construction and assembly.

BACKGROUND OF THE INVENTION

It is advantageous, in room air conditioners, to provide for a room air conditioner that is easily assembled, efficient and quiet during operation.

Typical prior art room air conditioners are assembled by building onto a base pan the component parts, i.e., compressor, motor, fan, blower, coil, bulkheads, and the like, one by one until the room air conditioner is completed. However, some room air conditioners have been constructed by assembling a number of modules linked structurally, functionally, and logically together into subunits, such subunits/modules then being placed together to form the completed or nearly completed room air conditioner.

Modular room air conditioners are not new. For example, Metcalf (U.S. Pat. No. 4,977,750) discloses a room air conditioner assembled from preassembled modular units. The modular units include a refrigeration system module having a compressor, condenser and an evaporator preassembled on a base. An air system module includes a fan, a motor, shrouds, and partitions preassembled as a unit. Electrical controls and a mounting panel are preassembled as yet another unit. The air system and control units are then attached onto the refrigeration system to produce a finished air conditioner unit.

Other patents disclosing modular room air conditioners include Hague (U.S. Pat. No. 4,223,503) and Perrone, et al. (U.S. Pat. No. 4,346,568). However, none of the prior art room air conditioner units provide for a modular room air conditioner having a number of applicants' unique features, directed to a modular assembly while improving efficient, quiet operation. These features include a unique motor mount for isolating the motor from the main chassis components to allow for quiet operation; integral shroud bulkhead units allowing the air-handling assembly to be completely preassembled prior to attachment to the base pan; strategically designed base pan with embossments for added strength, to control condensate flow, and to facilitate assembly of the refrigeration module in the modular scheme and chassis extraction from the shell; an enclosed control compartment limiting consumer access to electrical wiring and components; and a blower housing design including a scroll for directing air and effectively insulating the conditioned space from heat transmission and noise transmission to the inside, as well as a unique, modular air vent assembly for toolless engagement with the bulkhead of the air handling assembly.

Other novel features of applicants' modular room air conditioner include an air foil or baffle in the air plenum to reduce eddying or swirling and promote a more uniform flow (and thus promote quiet operation) in the room air conditioner.

Applicants' novel features also include a pair of nylon guide blocks attached to an outer shell to help guide the chassis into the shell. Further, holes along the rear wall of the base pan accommodate tabs in the shell to help prevent the chassis from bouncing during shipping.

Applicants' assembled chassis slips into a shell or sleeve defined by exterior walls, and contains a novel shell-retaining security strap to prevent the chassis from slipping out of the shell during shipping and also to prevent the chassis being removed from the shell from the exterior thereof in an installation.

Applicants also provide a novel blower housing design for use in assembling a modular air-handling module.

Applicants' unique method of modular assembly and quiet and efficient features provides a minimum need for adjustment, a minimum number of steps in the assembly, and provides for the ease of using, in some areas, prepainted metal. This helps reduce the cost of materials, promotes quiet operation, provides for fully electronic controls or electromechanical controls, as well as all of the aforementioned advantages.

SUMMARY OF THE INVENTION

An air conditioning unit comprising a refrigeration assembly, an air handling assembly, and a control assembly. The refrigeration assembly includes a generally rectangular base pan having upturned edges and a floor having a raised section, the base pan having a condenser, an evaporator, and a compressor mounted to an upper surface thereof. The air handling assembly includes a bulkhead having adjacent side wall portions, a scroll, a motor having an output shaft, a motor mount bracket for engaging the base pan of the refrigeration assembly, a fan, and a blower engaging the output shaft of the motor, a fan shroud and struts for mounting the shroud to the bulkhead and an air plenum assembly. The control assembly includes a compartment housing a control module or other control means.

DETAILED DESCRIPTION OF THE PREFERRED EMBODIMENT

Figures 1A, 1B:
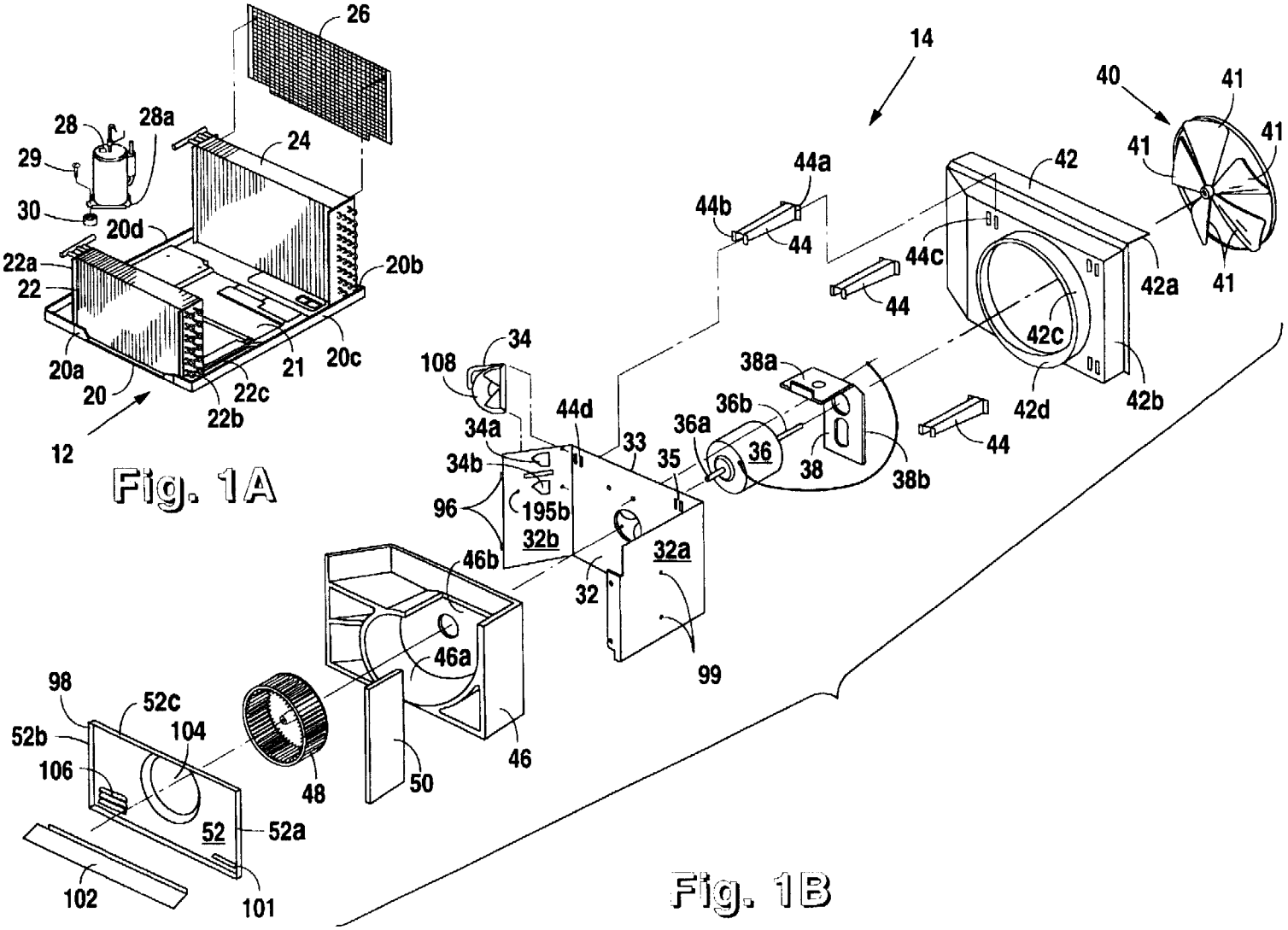
FIG. 1A is an isometric view of the refrigeration assembly module.
FIG. 1B is an isometric view of the air handling assembly module.
Figure 1C:
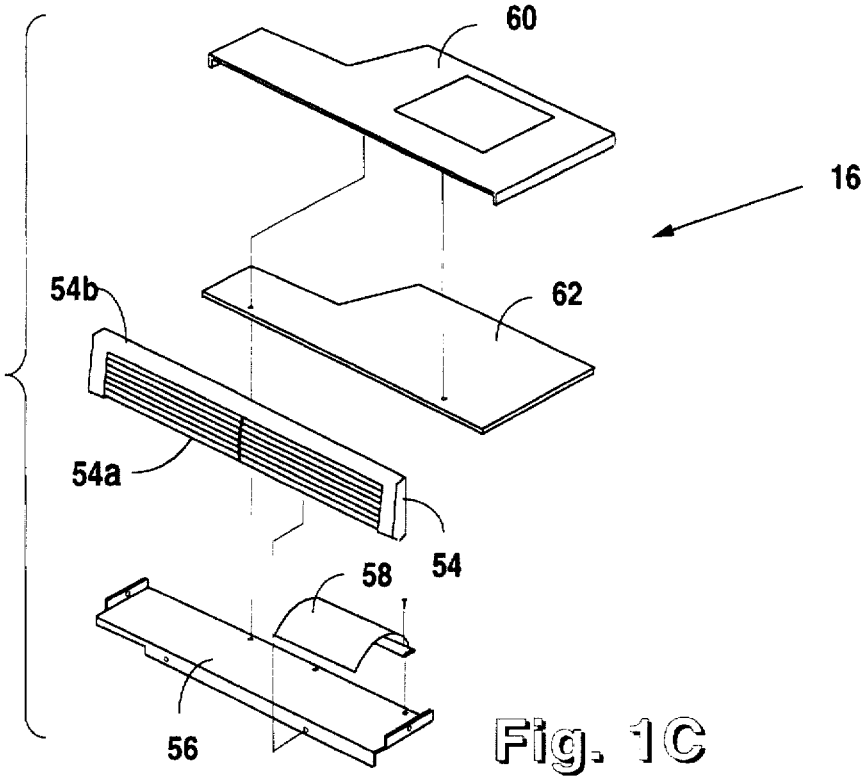
FIG. 1C is an isometric view of the discharge air plenum assembly.
Figure 1D:
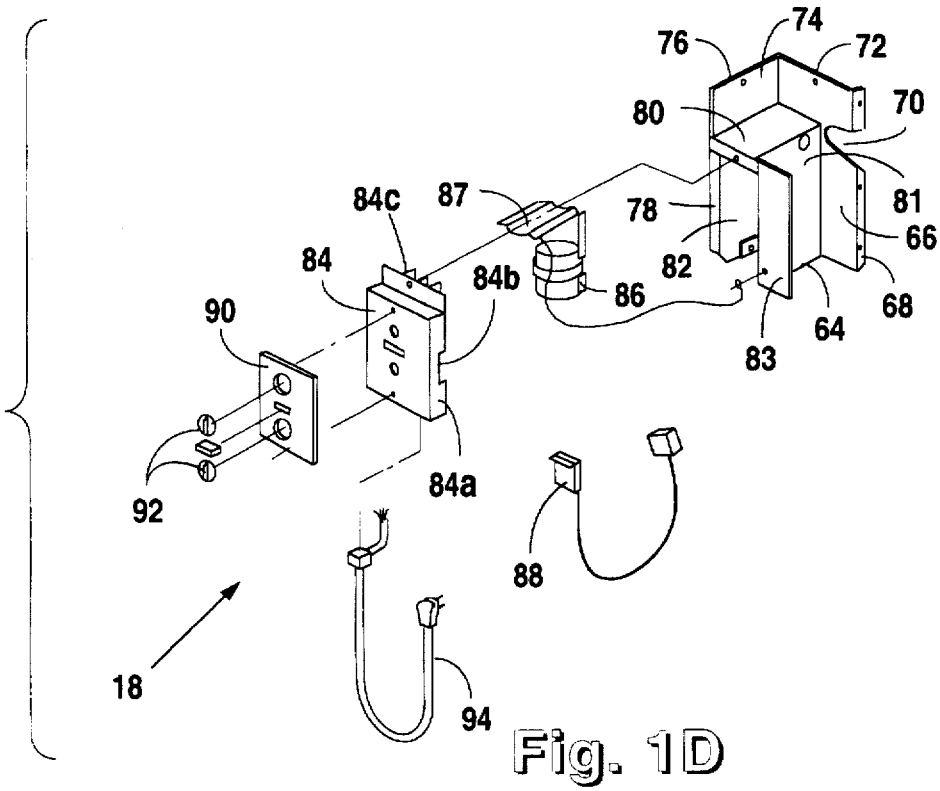
FIG. 1D is an isometric view of the control panel assembly module.

FIGS. 1A–1D illustrate the modular components of applicants' room air conditioner. These components include: refrigeration assembly (12) (FIG. 1A), air-handling assembly (14) (FIG. 1B), air discharge plenum assembly (16) (FIG. 1C), and control panel assembly (18) (FIG. 1D).

Turning now to FIG. 1A, the refrigeration assembly (12) includes a base pan (20) formed in a manner set forth in more detail below, which is designed to hold and anchor the remaining components of the room air conditioner. The base pan includes a floor (21) with up-turned edges, including front and rear edges 20*a* and 20*b*, respectively, and side edges 20*c* and 20*d*.

An evaporator (22) is mounted atop an evaporator drain pan (22*c*) and adjacent and parallel to front edge (20*a*) in an upright position, as is customary in the trade. The evaporator has mounting members (22*a*) and (22*b*) integral with and extending from the front left and right vertical edges of the evaporator body. Adjacent to rear edge 20*b* is mounted, with a vertical orientation, a condenser (24). Just at the rear of the condenser (24) is mounted a mesh grill (26) to prevent objects from striking the outer surface of the condenser (24). As is customary in the trade, a compressor (28) is mounted between the condenser (24) and the evaporator (22), utilizing mounting bolts (29) extending through a base (28*a*) of the compressor (28), through a rubber grommet (30) and into the floor (21) of the base pan (20). Typically, there are three bolts along with three of the rubber grommets, provided for anchoring the compressor to the base pan. Tubing is used to connect the compressor (28), the evaporator (22) the and condenser (24) in ways well known in the trade to complete the refrigeration assembly (12) of applicants' present invention.

Turning now to FIG. 1B and the air-handling assembly (14), it is seen that applicants' present invention includes a bulkhead (32) having right side wall (32*a*) and left side wall (32*b*). The right side wall (as seen from the front of the air conditioner) stands generally perpendicular to the rear of bulkhead (32) and the left side wall stands at an obtuse angle with rear of bulkhead (32). As can be seen in FIG. 1B, left side wall (32*b*) has in an upper portion thereof an exhaust vent assembly (34).

An electric motor (36) has extending therefrom a blower side shaft end extension of motor (36*a*) and a fan side shaft end extension (36*b*). The motor (36) is held to bulkhead (32) and floor (21) through the use of a unique motor mount bracket (38) having an arm (38*a*) for attaching to bulkhead (32) and leg (38*b*) for attaching to floor (21) of base pan (20). Motor mount bracket (38) attaches to motor (36) in a manner set forth in more detail below. However, at this point, it is well to note that motor (36) attaches at only two points: to the bulkhead (32) through blower side shaft end (36*a*) and to motor mount bracket (38) at leg (38*b*) through fan side shaft end (36*b*).

Attached to the outboard end of fan side shaft end (36*b*) of motor (36) is fan (40). The fan (40) has a multiplicity of blades (41) which rotate in response to energizing of the motor (36). Fan (40) is enclosed by a molded shroud (42). The shroud is comprised of a lip (42*a*), an adjacent body (42*b*), and a ring (42*c*), all to help protect the fan and direct the air against condenser (24). Specifically, lip (42*a*) seals against air and moisture from leaking out the top and ring (42*c*) has a crescent portion (42*d*) to help prevent the splash of condensate outside of the shroud.

Positionally maintaining the shroud (42) a fixed distance from bulkhead (32) is a see of rigid struts (44) toollessly located at one end to the corners of the body (42*b*) of shroud (42) and at the other end to the bulkhead (32). This allows shroud (42), motor (36) and fan (40) to be moved as a unit along with the bulkhead (32) and the remaining elements of the air handling assembly and positioned between condenser (24) and evaporator (22) for lowering onto base pan (20) and attaching as set forth in more detail below.

Figure 2:
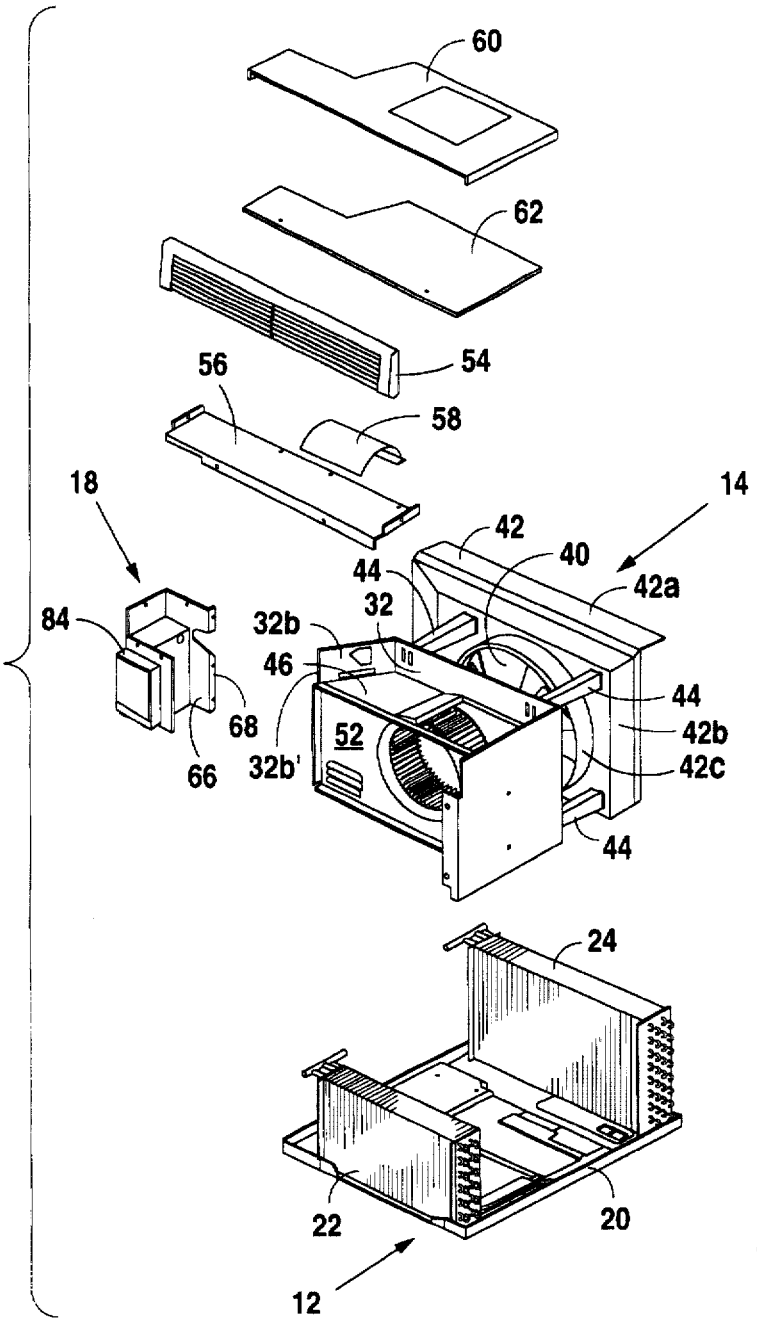
FIG. 2 is a schematic of the air conditioner unit assembly.
Figure 2A:
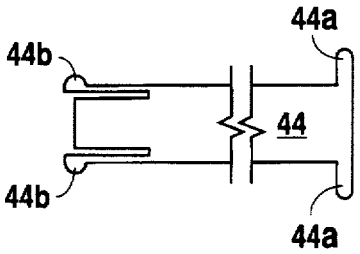
FIG. 2A is a plan view of the struts of the air conditioning unit.
Figure 3:
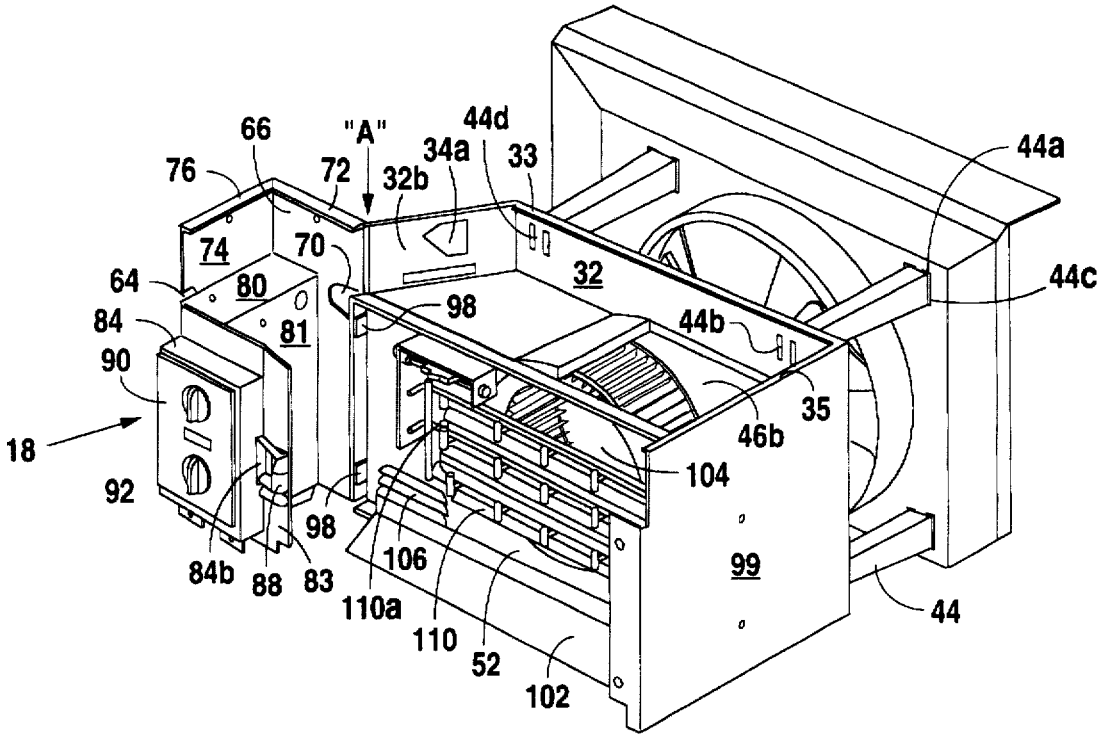
FIG. 3 is an isometric view of the control panel module assembled to the air handling module showing the electric heating element.

FIG. 1B, as well as FIGS. 2A and 3, provide more details on the manner in which struts (44) attach, without the use of tools, at one end to shroud (42) and at the other end to bulkhead (32). More specifically, it is seen how struts (44) have at one end thereof and projecting perpendicular to the side walls a pair of opposed lips (44*a*) shaped to slidably and snugly engage a pair of open channels (44*c*) located on shroud (42). On the opposite end of struts (44) are located a pair of oppositely opposed resilient prongs (44*b*) which lie in the same plane and act as an extension of the side walls of strut (44). These prongs are resilient and are designed to pop into a pair of similarly dimensioned slots (44*d*) located in bulkhead (32). Note that there are no tools required for easy and convenient attachment of struts (44) to, at one end the shroud, and at the other end, the bulkhead (32).

The foregoing is a description of the structure located rearward of bulkhead (32). The following description is directed to the structure located forward (in front of) bulkhead (32).

Turning now to FIGS. 1B and 3, it is seen that fittable to the front surface of bulkhead (32) and adjacent side walls (32*a*) and (32*b*) is a polystyrene scroll (46) made from molded expanded bead, such as Styrofoam®. Scroll (46) is seen to have walls defining a blower cage (46*a*) with a port (46*b*).

Applicants' use of the molded scroll in conjunction with the bulkhead and side walls provides an efficient, quiet method to direct room air through an evaporator and out a plenum, as described in more detail below.

As can be seen from FIG. 1B, scroll (46) is shaped to nest within the enclosure defined by bulkhead (32) and side walls (32*a*) and (32*b*). Scroll (46) is configured to accept a blower wheel (48) which is mounted to blower side shaft end extension (36*a*), the extension extending through holes through bulkhead (32) and scroll (46). A blower front panel (52), typically made of metal or plastic and having flanged side edges (52*a*) and (52*b*) and upper edge (52*c*), attaches to side walls (32*a*) and (32*b*) in front of scroll (46) as set forth in more detail below.

A generally rectangular expanded bead polystyrene panel (50) lies flush adjacent the inner wall of side wall (32*a*) covering the area forward of where flanged side edge (52*a*) of blower front panel (52) attaches to side wall (32*a*).

It is seen from the foregoing that the front of inner walls of bulkhead (32) and the inner surfaces of side walls (32*a*) and (32*b*) are covered with a heat and sound insulating material, typically an expanded bead polystyrene, such as Styrofoam®. Further, it is seen that applicants' use of the molded, one-piece scroll incorporates the functions of handling the air and also insulating bulkhead (32). It is important to insulate the surfaces of bulkhead (32), including side walls (32*a*) and (32*b*) as motor (36) mounts (and could therefore transmit vibration) to this unit. Further, the bulkhead and the side walls in typical air conditioning units represent a large vibrating area, akin to a drum head, and can effectively magnify harmonics to the frequency of rotation of the motor.

Turning now to FIGS. 1C and 2, it is seen that applicants provide an air discharge plenum assembly (16). A plenum discharge air grill (54) is provided having a lower edge (54*a*) with tabs to which is attached a deck (56) which is dimensioned to and will overlay the top of evaporator (22). Deck (56) is attached by screws or other suitable means to one end to side wall (32*a*) and at the other end to upper side wall (74) of housing (64) (see FIG. 1D). Deck (56) includes a baffle portion (58) to reduce turbulence and enhance a uniform (and thus quieter) flow of air into the room. The baffle portion lies on the floor of deck (56) just forward of port (46*b*) with a convex outer surface engaging air leaving the port to smooth the air flow. Along a top edge (54*b*) of plenum discharge air grill (54) lies a metal plenum cover (60) underlaid with a similarly shaped expanded bead polystyrene insulation pad (62). Air discharge plenum assembly (16) is assembled, piece-by-piece, onto the unit after refrigeration assembly (12), air-handling assembly (14) and control panel assembly (18) have been mounted on base pan (20).

FIGS. 1D, 2, 3 and 4 illustrate the control panel assembly (18) of applicants' present invention. The control panel assembly (18) includes a rigid metal housing (64) which has a number of walls, the housing (64) designed to integrate with left side wall (32*b*) to extend bulkhead (32) across base pan (20) and also to help define the discharge air flow chamber when combined, in a material part, with air discharge plenum assembly (16).

Returning now to housing (64), it is seen that it includes first side wall (66) having a side wall lip (68) thereon. Part of side wall (66) includes a cut-out (70) for allowing the extension of a suction tubing from the evaporator therethrough. It is further seen how side wall (66) has a top lip (72) extending therefrom to assist in sealing the discharge air flow chamber of the air discharge plenum assembly. A shell (78) also extends from and is part of housing (64), and is designed to partially enclose a capacitor (86) within walls (80) and (81) thereof. That is, shell (78) has walls (80) and (81) defining a capacitor cavity (82). Cavity (82) is enclosed by mounting thereon a control panel (84) with either touchpad control (see FIG. 4), or a set of manual electrical knobs (92) (see FIG. 3) for operating motor (36) and the rest of the components of the room air conditioner (except the exhaust vent assembly 34) allowing user input via a multiple of knobs (92) on a control plate (90) mounted to the control panel. Housing (64) also encloses capacitor (86) having a mounting bracket (87) attached thereto, the mounting bracket for engaging a rearward facing extension (84*c*) of the control panel.

When Applicants' preferred embodiment utilizes electromechanical knobs (92) in place of a fully electronic touchpad embodiment, a heat/cool anticipator (88) (see also FIGS. 5A–5D) is wired through to control panel (84) and is mounted between evaporator (22) and a front grill of the room air conditioner. Note control panel (84) has side wall (84*a*) with walls defining cutout (84*b*) to seal within the control panel the leads to the heat/cool anticipator (See FIG. 5D) by engaging grommet (134). A power cord (94) designed to engage an electrical outlet, energizes motor (36) and compressor (28) through the control panel (84).

Figure 4:
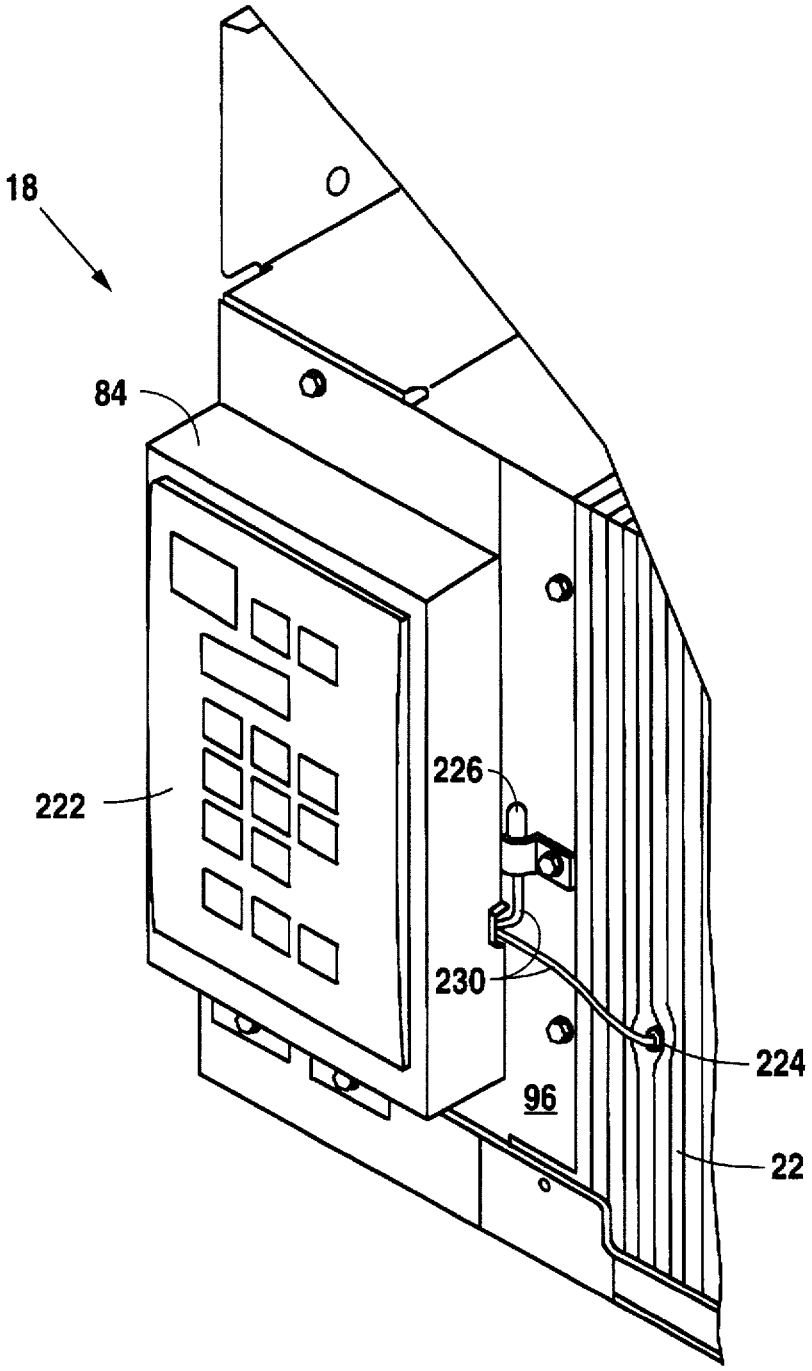
FIG. 4 is an isometric view of the touchpad control and thermistor assembly.

FIG. 4 illustrates the use of applicants' fully electric touchpad embodiment, including control panel (84) having an electronic control face touchpad (222) having controls related to fan speed, temperature, mode, power, and timer. The fully electronic touchpad embodiment can handle the same control functions as the electromechanical knobs but, instead, uses touchpad (222). Inserted in the evaporator coil (22) is a de-ice sensor (thermistor) (224) to sense the temperature of the evaporator coil to prevent ice buildup by turning off the compressor but leaving the fan on when the evaporator drops to a predetermined temperature and reactivates the compressor when the temperature moves above that temperature. An indoor temperature control thermistor (226) is mounted to panel (96) to measure indoor (return) air (ambient) temperature. Both thermistors engage circuits of control panel (84) through leads (230). It is noted that the shape of the control panel of the fully electronic control panel is the same as that of the electromechanical control panel to make assembly of the two units, through assembly of the related subcomponents, nearly identical.

FIG. 2 helps illustrate the order in which the air conditioner is assembled. The compressor is not shown for the sake of clarity. Refrigeration assembly (12) accepts air-handling assembly (14) by vertically lowering the air-handling assembly onto the base pan and affixing it thereto at a number of points by the use of fasteners in ways known in the trade. It is seen from FIG. 2 that blower front panel (52) will lay adjacent and parallel to the rear surface of evaporator (22) with the rear edge of deck (56) meeting the upper edge of front panel (52). To the rear of the air-handling assembly, fan (40) is positioned adjacent and parallel to the forward surface of condenser (24). It is intended also that lip (42*a*) of shroud (42) extends over the top surface of the condenser.

After completing attachment of the air-handling assembly to the refrigeration assembly, the control assembly is attached. This is done by attaching flanged edge (32b') of side wall (32b) to lip (68) of side wall (66) of control panel assembly (18). This is done in a conventional manner using, typically, fasteners such as screws. When the control assembly is attached in this manner, it will be seen that side wall (66) along with side wall (32b) and bulkhead (32) complete the barrier separating a blower-controlled section of the air conditioner forward of the bulkhead and a fan-controlled area rearward of the bulkhead.

With reference to FIGS. 1A–1D, 2, and 3, additional features of the composite air-handling/control assembly may be appreciated. First, the arrow designated "A" in FIG. 3 signifies the juncture, set forth in the paragraph above, of the side wall (66) to left side wall (32b). Further, it is seen how side wall (66) along with walls (81) and (83) partially enclose the left side wall (as seen from the front) of evaporator (22). Further, it is seen how upper lip (33) of bulkhead (32), upper lip (35) of right side wall (32a), and upper lips (72) and (76) together provide structure for mounting the edges of metal cover (60) of the air discharge plenum assembly (16) to provide a substantially closed air plenum for discharging air into the room under the urging of blower wheel (48).

FIGS. 1B, 2 and 3 also illustrate the manner in which blower front panel (52) attaches to the remaining elements of the air-handling assembly, specifically, notched bosses (96) extending from flanged edge (32b') toollessly engage slots (98) of blower front panel (52). Screws inserted through holes (99) of right side wall (32a) will engage holes (101) in flanged edge (52a) of front panel (52). FIGS. 1D and 3 also illustrate the manner in which skirt (102) attaches to the lower edge of blower front panel (52) in such a manner as to shield the evaporator drain pan (22c) that the evaporator rests on from electrical heater element (110). The electrical heater element rests on hooks (110a) located on front panel (52) to hang in the airstream created by the blower, and is energized through the control panel. Fresh air intake louvers (106) work in conjunction with the exhaust vent assembly (34).

FIGS. 1B, 2, 3 and 3A–3G illustrate the structure, operation and assembly of vent assembly (34). The exhaust vent assembly (34) includes two ports, upper (exhaust) port (34a) and lower (fresh air) port (34b). These ports work in conjunction with pivotally mounted vent door assembly (108) (see FIGS. 1B and 3A) which is operated on a cable having a knob at the first end which is accessible to the user, the knob to be moved back and forth selectively, positioning vent door assembly (108) either to cover both ports (normal operation), or, in one position, opening only the upper port (exhausting room air) and, in the other position, opening only the lower port (bringing in outdoor air).

Figure 3A:
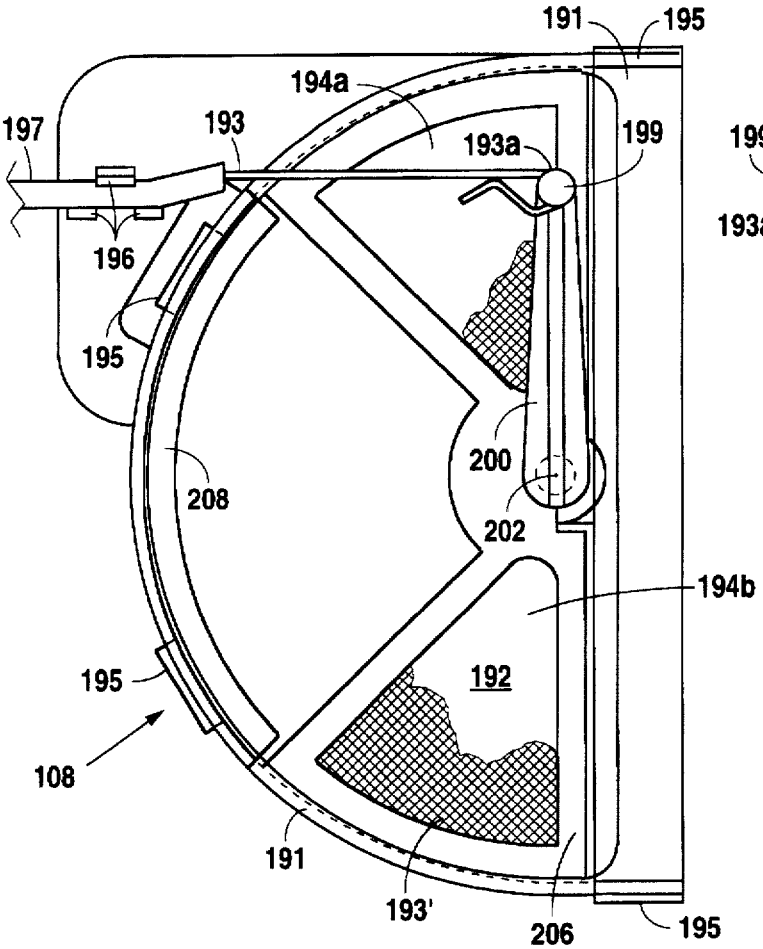
FIG. 3A is a front elevation view of the vent door assembly.
Figure 3B:
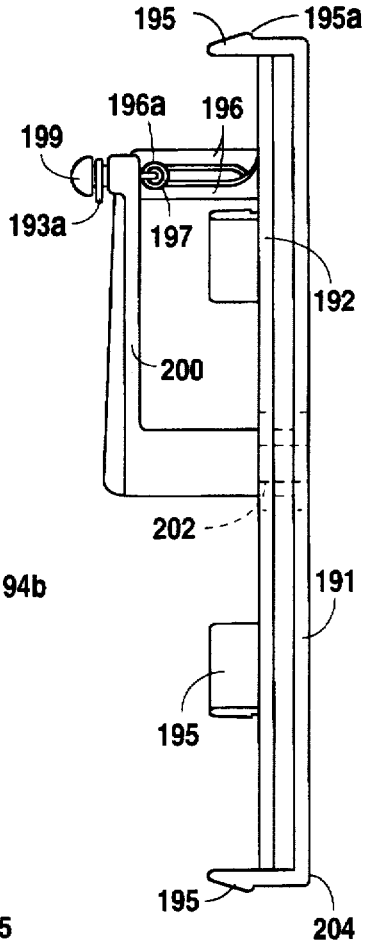
FIG. 3B is a right side view of the vent door assembly.
Figure 3C:
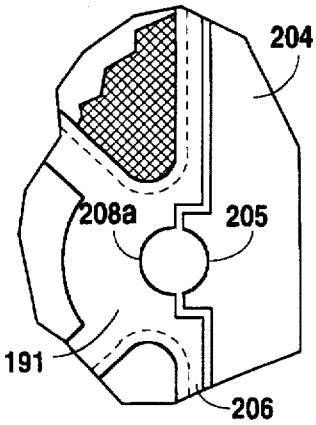
FIG. 3C is a closeup view of the vent frame where the actuating arm fastens.
Figure 3D:
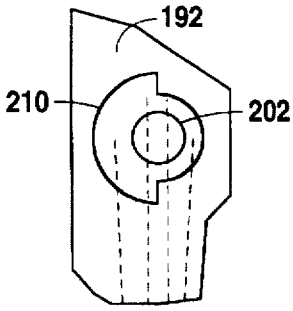
FIG. 3D is a detailed view of the actuating arm in the rotating plate.
Figure 3E:
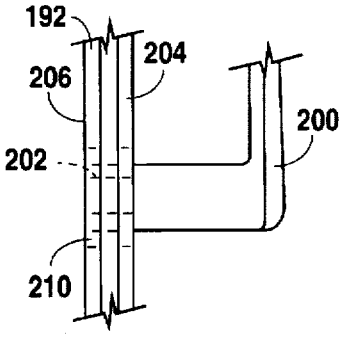
FIG. 3E is a detailed view of the assembly showing the actuating arm, rotating plate, and vent frame.
Figure 3G:
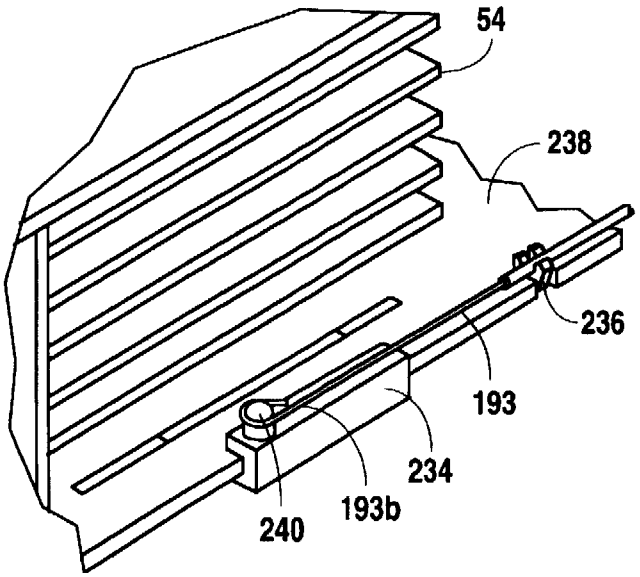
FIG. 3G is an enlarged view of the slider and cable assembly.
Figure 3F:
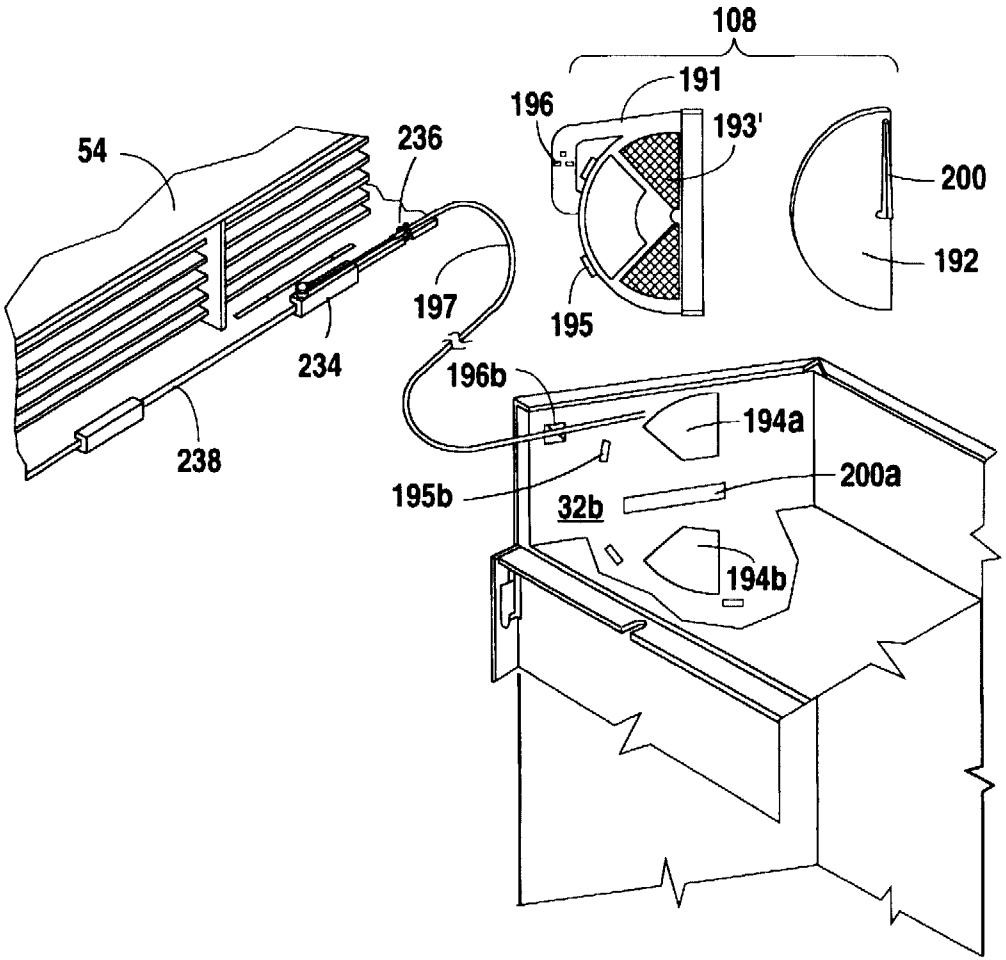
FIG. 3F is a detailed view of the vent assembly fitting the bulkhead.

Vent door assembly (108) is comprised of two main parts: a vent frame (191) to which is pivotally attached a rotating vent plate (192) (see FIG. 3F). Both vent frame (191) and rotating vent plate (192) are generally semicircular in profile. A cable (193) with a second end (193b) accessible to a user and mounted to the outside of the room air conditioner has a first end (193a) mounted to the rotating plate such that actuating the cable will cause the rotating vent plate to pivot with respect to vent frame (191). As is seen in FIG. 3A, vent frame (191) has two mesh-covered, pie-shaped openings: upper (exhaust) cut-out (194a) and lower (fresh air) cut-out (194b). Vent frame (191) is mounted to bulkhead side wall (32b) such that the upper and lower cut-outs lie flush against the upper and lower ports (34a) and (34b), respectively.

Turning now to additional details of door assembly (108), it may be seen that four mounting prongs (195) are integral with vent frame (191) and located on the perimeter thereof. Typically, all parts of door assembly (108) are made of resilient plastic, including prongs (195), which have a lip portion (195a) (see FIG. 3B). Being resilient, they are designed to toollessly engage four similarly dimensioned slots (195b) (see FIGS. 1B and 3F) in left side wall (32b). Further, it is seen how mesh members (193') cover both upper cut-out (194a) and lower cut-out (194b) to prevent particulate material from passing therethrough.

A portion of vent frame (191) includes resilient cable mounting members (196) which have cup-shaped portions (196a) which are designed to resiliently and releasably engage cable housing (197). The latter is typically made of Teflon® to allow for ease of sliding of cable (193) within the cable housing. Cable mounting members (196) with cup-shaped portions (196a) will hold cable housing (197) in a resilient, friction-holding manner. Cable (193) has removed end (193a) which engages knob (199) on actuating arm (200). Actuating arm (200) pivots at axle (202) to move rotating plate (192).

Rotating plate (192) is designed to toollessly engage and articulate with vent frame (191) without the use of fasteners. More specifically, it is seen that vent frame (191) includes lower support member (204) having a centrally located projecting cup-shaped portion (205). Upper member (206) of vent frame (191) has cup-shaped cut-out (208a) overlying cup-shaped cut-out on projecting portion (205) in the manner set forth in FIG. 3C, the two cup-shaped halves being opposite one another as viewed in FIG. 3C from above or below, but offset horizontally as seen in FIGS. 3B and 3F, a distance sufficient to accept the thickness of the rotating plate. Vent frame (191) further includes a plate-engaging lip (208) designed to engage the curved perimeter portion of rotating vent plate (192). Axle (202) includes disk portion (210) that has a diameter substantially greater than that of axle (202). Axle (202), disk portion (210) and actuating arm (200) are all integral molded as part of rotating plate (192) in one piece. Further, the diameter of disk portion (210) is greater than the circle formed by cup-shaped cut-out (208a) and projecting cup-shaped portion (205). That particular diameter is equal to the diameter of axle (202). The upper and lower members being flexible allow rotating plate (192) to slip between upper and lower members (204) and (206), respectively, such that the curved portion of the perimeter of the rotating plate slips beneath plate engaging lip (208) and the axle fits snugly in the cut-out circle formed by (205) and (208a), the rotating plate being held in place by the action of disk portion (210) on upper member (206) as more specifically set forth in FIGS. 3D and 3E.

FIGS. 3F and 3G provide additional illustrations in the manner in which the exhaust vent assembly (34) is provided and operates. Basically, door assembly (108) attaches to left side wall (32b) through the use of mounting prongs (195) engaging slots (195b). Further, it is seen that cable mounting members (196) are placed through cut-out (196b) in side wall (32b). In this manner, vent door assembly (108) attaches toollessly and easily flush against side wall (32b). FIG. 3F also illustrates how slot (200a) in left side wall (32b) is provided to allow activating arm (200) access through the side wall to cable (193).

FIG. 3G illustrates the manner in which discharge air grill (54) locates slider (234). More specifically, cable housing (197) snap fits into prongs (236) located along lower edge (238) of front grill (54). It is seen that slider (234) has on an upper surface thereof knob (240) for locating removed end (193b) of cable (193).

Also illustrated in FIG. 3 is the use of electric heater coils (110) which are wired to the control box such that they may be selectively energized through the outside power supply to help heat the room. It is seen how electric heater coils (110) are set across blower opening (104) to heat the surrounding air passing over the elements through convection when they are energized.

With reference to FIGS. 1B, 2 and 3, it may be appreciated now that the addition of deck (56) to side walls (32*a*) and (74) while also attaching to upper edge (52*c*) of blower front panel (52) helps separate the low pressure portion at and forward of blower opening (104) from a high-pressure region created by the cooperation of the air-handling assembly and the plenum assembly which exists at port (46*b*) during the period in which blower wheel (48) is energized.

Figure 4A:
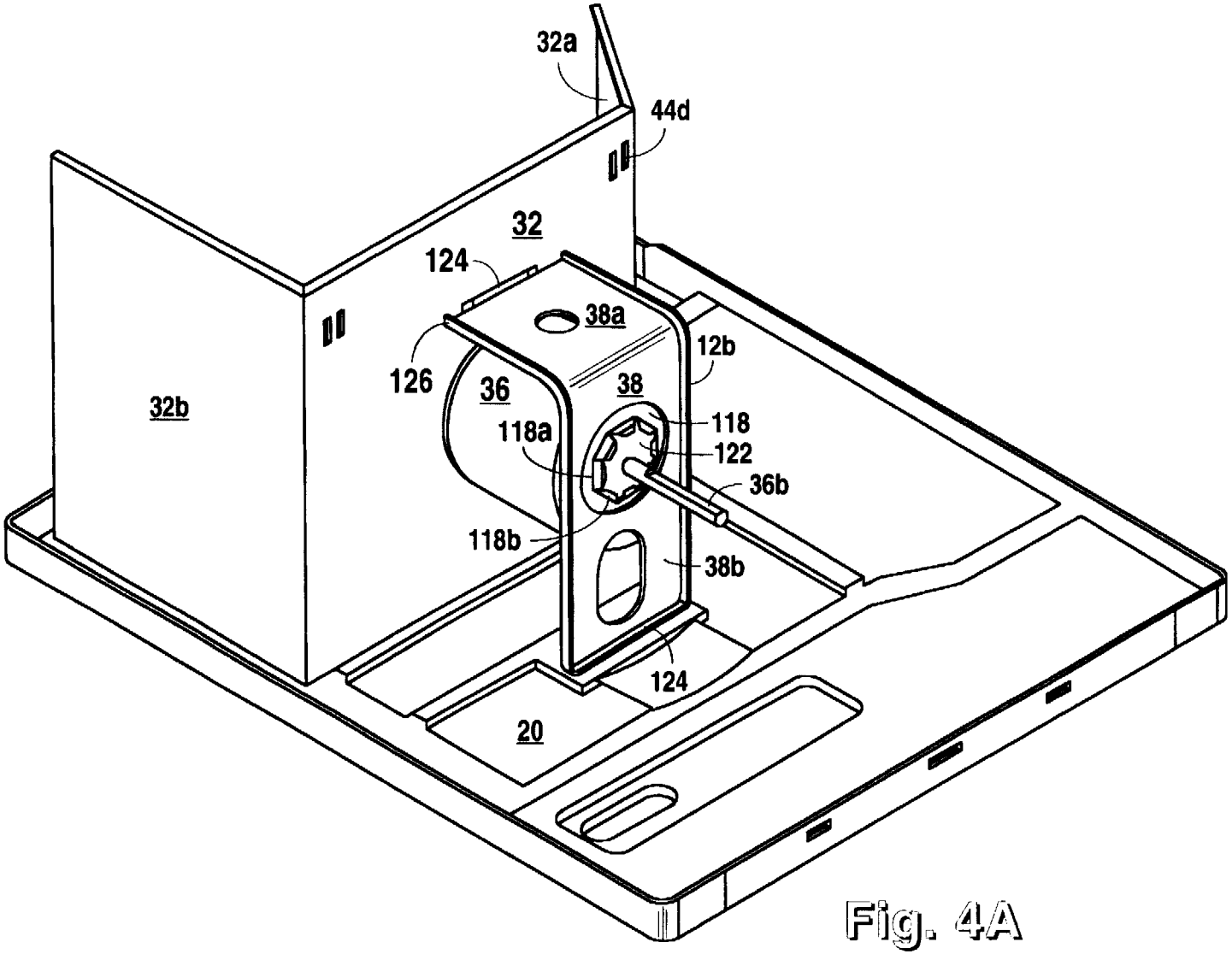
FIG. 4A is an isometric view of the motor and bracket assembly method to base pan and bulkhead.
Figure 4B:
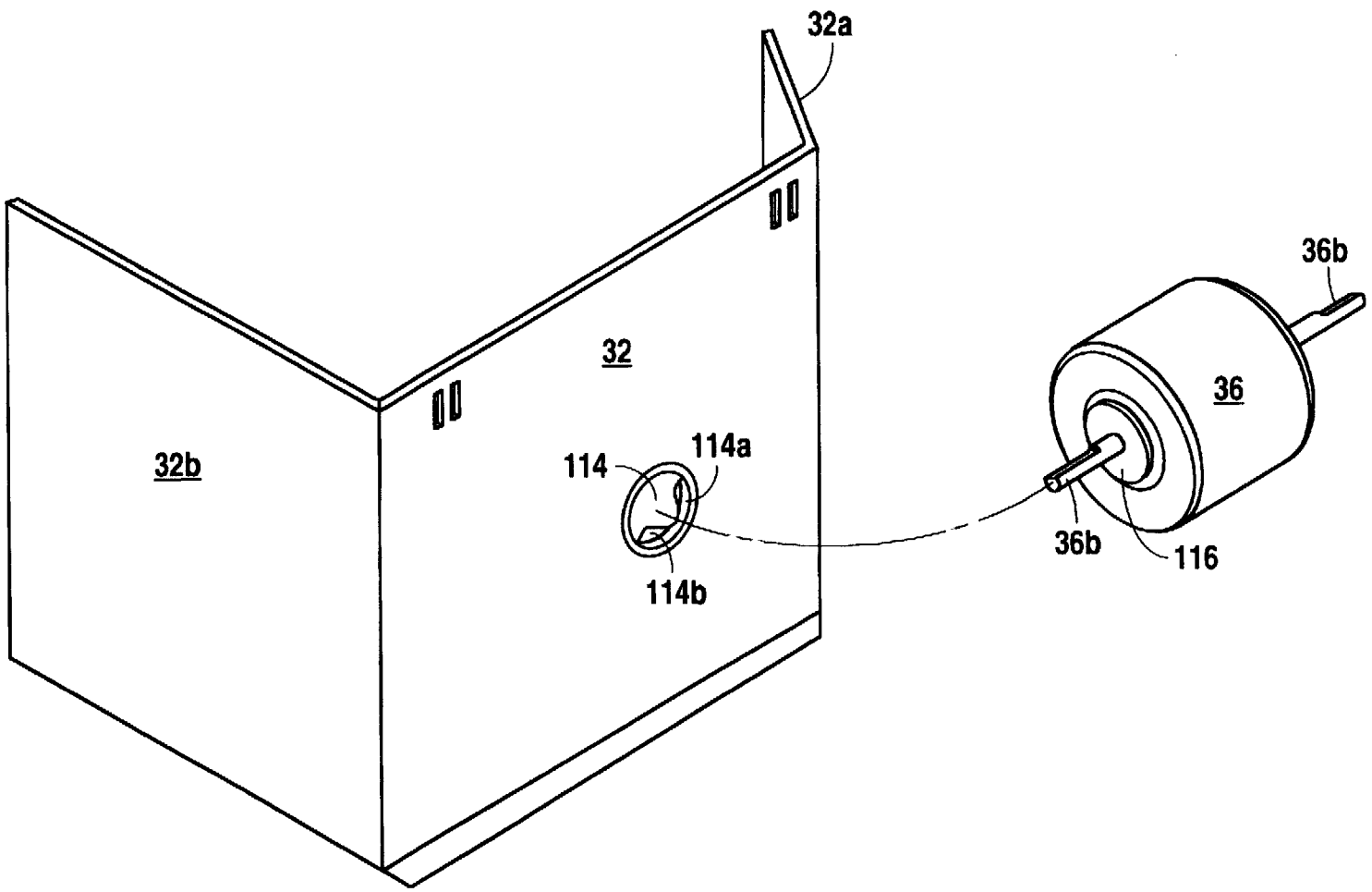
FIG. 4B is an isometric view of the motor support method at bulkhead end.

FIGS. 4A and 4B illustrate details of applicants' motor mount bracket (38). Applicants' motor mount bracket (38) is seen to have an arm (38*a*) and leg (38*b*). Motor (36) has shaft extensions (36*a*) and (36*b*) extending out either end. In bulkhead (32), centrally located, is hole (114) having flanges (114*a*) with lips (114*b*). Motor (36) is mounted to bulkhead (32) by insertion of round, resilient ring (116) of motor (36) press fitted into hole (114) until it is seated against flanges (114*a*) and lips (114*b*). Next, applicants' motor mount bracket (38) is inserted over a non-round, resilient ring (122), such as the octagonal ring illustrated in FIG. 4A. Leg (38*b*) of motor mount (38) has non-round recess (118) having flanges (118*a*) and lips (118*b*) shaped to snugly receive non-round, resilient ring (122) therein. When the press fit of non-round resilient ring (122) into non-round recess (118) is achieved, motor mount bracket (38) is attached to bulkhead (32) and base pan (20) through the use of fasteners along lips (124). Note that motor mount bracket (38) has turned up edges (126) to aid in rigidity.

The net effect of providing mounting as indicated is to isolate motor (36) from the rest of the apparatus through the use of resilient mounting means, here a non-round (triangular, square, pentagonal, etc.) and a round, resilient ring located where the output shafts (36*a*) and (36*b*) come out of either end of motor (36). The use of applicants' unique, non-round, resilient ring prevents the rotation of the motor, which rotation could occur especially during start-up of the motor or shutdown of the motor when torque loads are unbalanced. Applicants have found that the use of the unique non-round rubber motor mount combined with individual supports at each end of the motor dampens the transmission of vibration of the motor between the motor and the air conditioner chassis. Preventing vibration transmission between the motor and the chassis helps quiet the operation of the air conditioner.

It should be noted, however, that, alternately, the motor mount bracket could have the round cup and the wall the polygonal cup, or they could both have polygonal cups with polygonal resilient rings. Preferably, only one polygonal cup is used and that is on the motor mount bracket.

FIGS. 5A through 5D illustrate details of applicants' one-piece, lead and resistor encapsulated, heat/cool anticipator (88). Applicants incorporate herein by reference the specifications and figures of U.S. Pat. No. 3,474,639 and U.S. Pat. No. 3,636,724, which illustrate assignee's prior embodiments of heat/cool anticipators. Details of applicants' present heat/cool anticipator include differences (as compared to those disclosed in the two incorporated patents) in structure, mounting location and function as set forth in more detail below.

Basically, the heat/cool anticipator applicants provide herein operates on the same principle as the prior patented heat/cool anticipators as set forth in the two referenced patents. That is, heat generated by a current-carrying resistor in close proximity to a sensor will energize a compressor before the ambient temperature of the room alone could cause the sensor to activate (through the thermostat) the compressor.

Figure 5B:
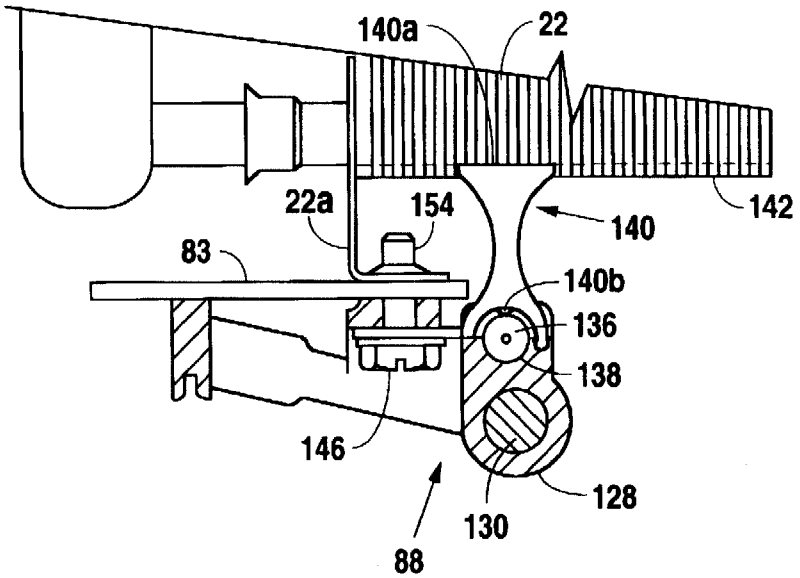
FIG. 5B is a sectional plan view of the thermostat assembly attachment to evaporator coil and bracket.
Figure 5A:
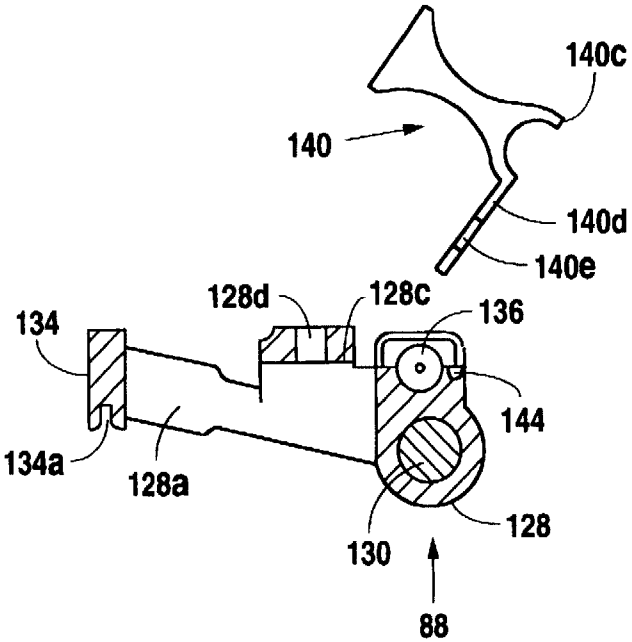
FIG. 5A is a sectional plan view of the heat/cool anticipator thermostat assembly.
Figure 5D:
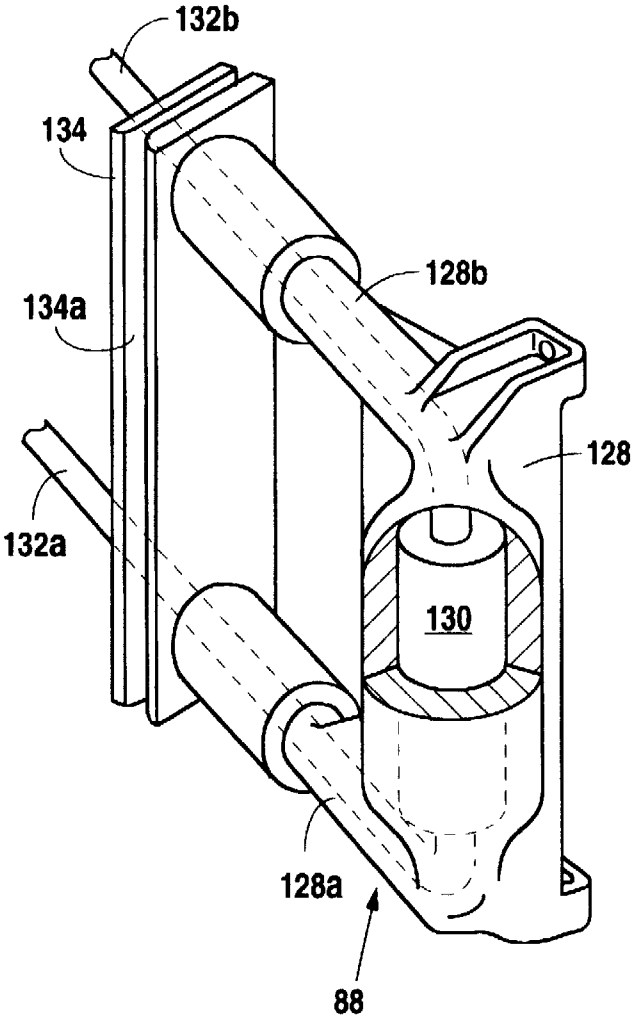
FIG. 5D is a cutaway view of the anticipator resistor.
Figure 5C:
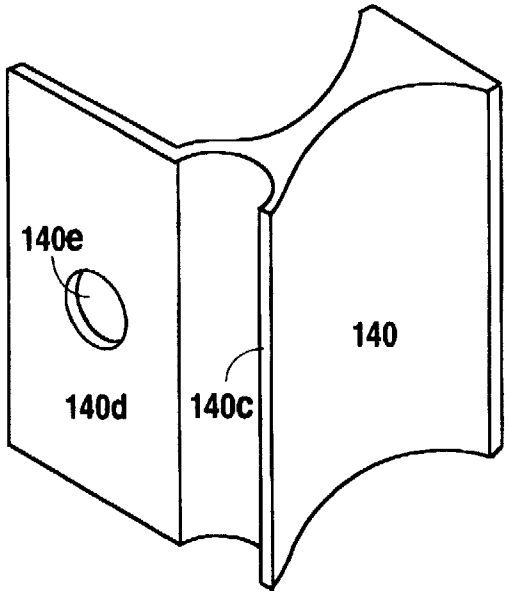
FIG. 5C is an isometric view of the conductor block.

Applicants' heat/cool anticipator (88) is seen to have an elongated body (128) which is dimensioned to encapsulate a resistor (130). Body (128) is seen to have extending laterally therefrom a lower arm (128*a*) and an upper arm (128*b*). The arms enclose leads (132*a*) and (132*b*) which are connected to and carry current to resistor (130). Located on and integral with the removed ends of each of lower arm (128*a*) and upper arm (128*b*) is a grommet (134) having a groove (134*a*) therein. Grommet (134) is used for sealingly mounting anticipator (88) to the control box (see FIG. 1D). As seen in FIGS. 5A and 5B, plastic body (128) completely encapsulates resistor (130) to prevent access to the electrical components (leads and resistor) and also has walls dimensioned to receive thermostat sensor (136), the sensor typically ball or cylindrically shaped. The preferred plastic is Noryl® from G.E. which has the proper flammability characteristics (U.L. 94 also called 5V) and dielectric characteristics. Sensor (136) fits flush against contoured surface (138) of body (128) such that friction alone will hold sensor (136) in place. It is noted that contoured wall (138) in plastic body (128) is designed such that there is a flush fit between the walls of sensor (136) and body (128). Thus, heat generated by resistor (130) travels by conduction only through body (128) before it reaches sensor (136). Applicants' heat/cool anticipator (88) also includes a conductor block (140) designed to flush fit against a multiplicity of contact fin ends (142) of evaporator (22). One of the functions of the heat/cool anticipator (88) is to anticipate evaporator coil freeze-up and shut off the compressor in response thereto. This function is assisted by applicants providing conductor block (140) which directly engages the fins of evaporator (22), transmitting the temperature differences to sensor (136) primarily by conduction from the fins. Conductor block (140) is seen to have flat end surface (140*a*) for effective contact against the fin ends of the evaporator. Opposite flat end surface (140*a*) is curved end surface (140*b*). It is seen in FIG. 5B how curved end surface maintains a uniform gap with respect to the curved outside walls of sensor (136). This is an air gap which somewhat tempers heat transfer between the walls of sensor (136) and curved end (140*b*).

For mounting, conductor block (140) has lip (140*c*) which is provided for insertion into similarly dimensioned notch (144) in body (128). The engagement of lip (140*c*) with notch (144) positions block (140) adjacent sensor (136). Conductor block (140) has opposite lip (140*c*), a leg (140*d*) having hole (140*e*) therein. This is provided to mount through the use of fastener (146) the conductor block to the body and the anticipator to the evaporator of the room air conditioner as illustrated in FIG. 5B. After lip (140*c*) is inserted into notch (144), leg (140*a*) is rotated so that it lays flush against leg (128*c*) of body (128) such that holes (140*e*) and (128*d*) are aligned. Fastener (146) then attaches the heat/cool anticipator (88) to wall (83) and to mounting member (22*a*) (see also FIG. 1D). The mounting of anticipator is done so that flat end surface (140*a*) rests firmly against fin ends (142) and so that slot (134*a*) of grommet (134) fits flush into cutout (84*b*) of control panel (84) making access to the electrical leads more difficult after assembly.

Applicants' encapsulation of resistor (130) in plastic body (128) has the advantage of tempering heat transfer between the sensor and the resistor. Further, applicants' heat/cool anticipator is placed directly in the evaporator's air stream. As illustrated, the heat/cool anticipator is just upstream of the fins at the front of the evaporator (22). By encapsulating the resistor and leads, the heat/cool anticipator can be placed in front of the coil instead of in the secondary air flow, as illustrated in the referenced patents. Consumer access to the heat/cool anticipator is less of a concern as a result of the encapsulation. From a manufacturing standpoint, the control panel assembly (18) can be manufactured independent of all other components of the room air conditioning system. This is important in the modular approach to applicants' room air conditioner, the approach dictating subunits that can be assembled separate from other subunits. That is, the heat/cool anticipator is now part of the control module and may be built as part of that subassembly. Moreover, the resistor and leads are not accessible to the consumer, as they are fully encapsulated in body (128).

Use of the heat/cool anticipator with a straight cooling or a heat/cool system allows the anticipator to shorten the on cycle when the unit is used as a heater and shorten the off cycle when it is used in cooling, as more particularly set forth in the prior patents incorporated by reference.

Figure 6B:
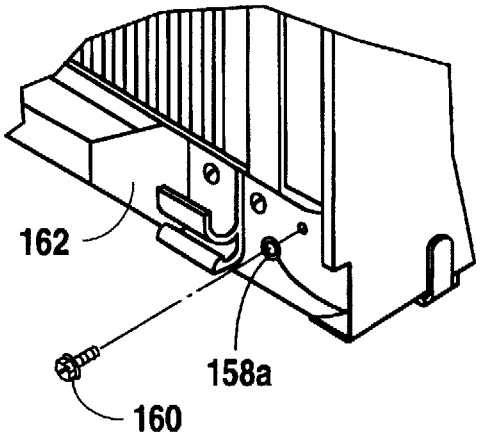
FIG. 6B is a detailed isometric view of the outer shell and security strap assembly.
Figure 6A:
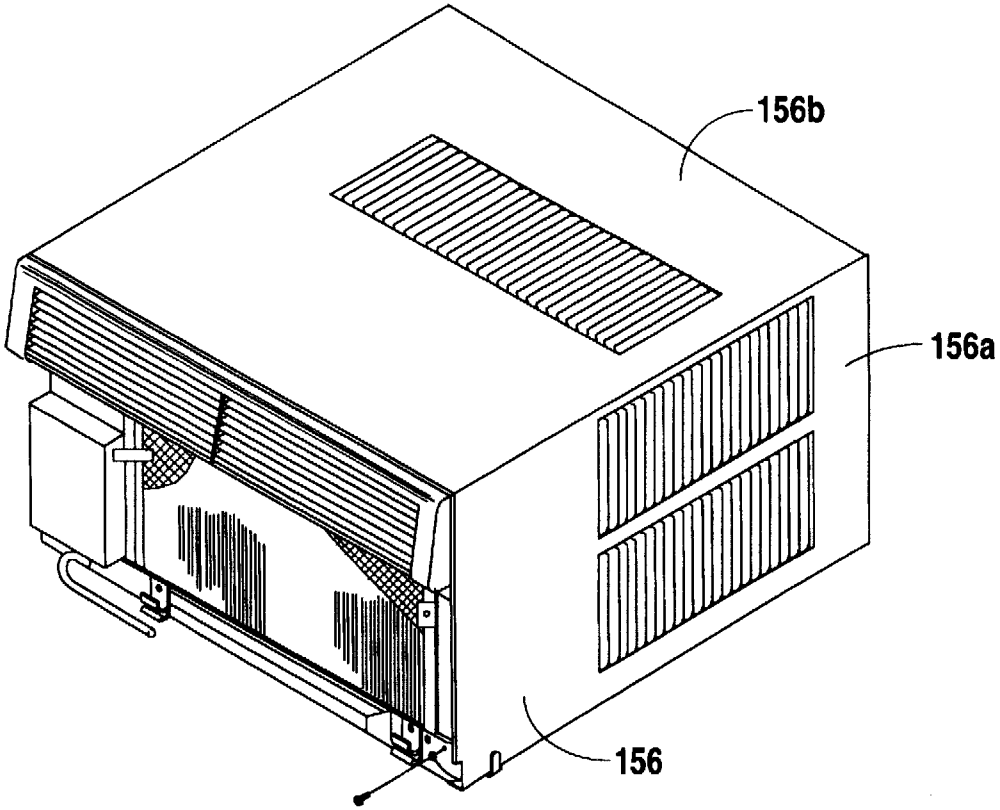
FIG. 6A is an isometric view of the outer shell and security strap assembly.

FIGS. 6A and 6B illustrate the use of applicants' shell (156) which is essentially comprised of four walls exterior in rectangular configuration. Side wall (156*a*) and top wall (156*b*) are illustrated here. The walls enclose the base pan of applicants' invention with all of the subassemblies contained thereon, henceforth referred to as chassis. The chassis slides into shell (156) and is retained by the use of a security strap (158), typically made of spring steel. Security strap (158) has a loop at both ends. First end (not illustrated) is attached by a screw anchored into shell (156). Second end (158*a*) is attached by a screw (160) anchored into front edge (162) of base pan. It is to be noted that security strap (158) is inaccessible from that portion of the room air conditioner unit that would extend outside of the room and into the outside ambient air. The use of security strap (158), anchored to both the chassis and the shell, helps prevent the chassis being removed from the shell from outside of the house or building. Additionally, strap (158) restricts movement of the chassis in the shell during shipping.

FIGS. 7A through 7E illustrate details of applicants' base pan (20). As seen with reference to the figures, base pan (20) has upstanding edges comprising front edge (20*a*), rear edge (20*b*), left side edge (20*c*), and right side edge (20*d*), as seen in a plan view. Within the base pan edges is floor (21), much convoluted (as set forth in more detail below), the floor having an upper surface (21*a*) and a lower surface (21*b*). Compared to prior art pans, applicants' have higher edges, creating greater volume (hence greater water holding capacity), the edges typically standing 0.5 inch to 1.0 inch above the trough floor of the base pan. Typically, base pan (20) is made of about 16 to 18 gauge galvanized steel. Applicants' design uses generous radii of curvature, such as at the boundary of walls (20*a*), (20*b*), (20*c*) and (20*d*) and floor (21) to allow the option of using prepainted metal. With too tight a radii of curvature, paint on prepainted metal tends to crack. Typically, applicants' radii of curvature is in the range of 0.25 inch to 0.8 inch when forming the base pan.

Applicants' base pan is strategically designed with embossed regions to add strength and diminish vibration. Further, part of the design shape of applicants' base pan functions to control condensate from the coils, to facilitate the joinder and assembly of parts and subassemblies, and to facilitate acceptance of the shell, all as more particularly set forth below.

Figure 7A:
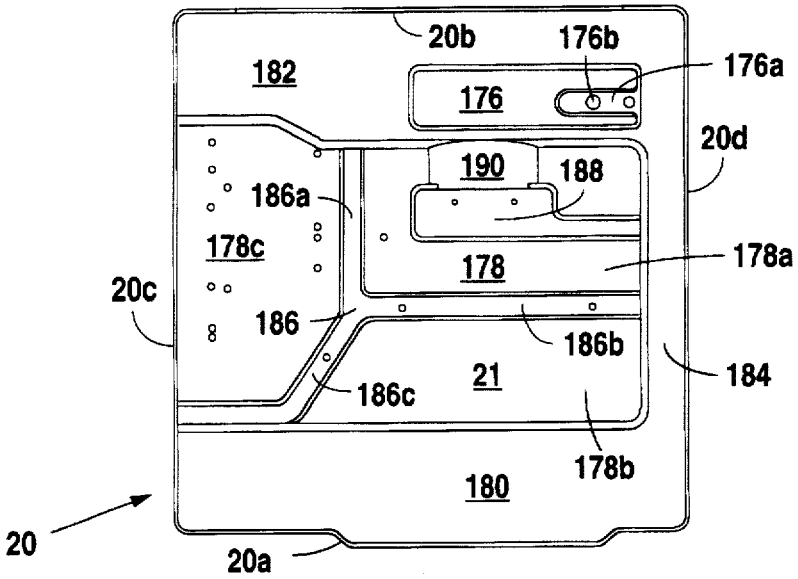
FIG. 7A is a top view of the base pan.
Figure 7B:
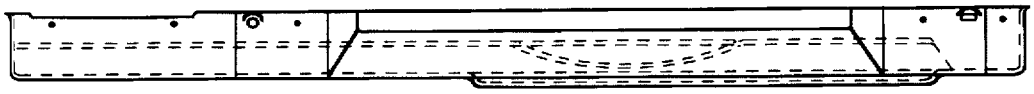
FIG. 7B is a front elevational view of the base pan.

Turning now to the details of applicants' edges (20*a*), (20*b*), (20*c*) and (20*d*), it is seen that the edges have an upper perimeter that is flanged outward. Turning to FIG. 7B, front edge (20*a*) is further seen to have a slot (166*a*) and a hole (166*b*) near the upper perimeter thereof for acceptance of fasteners to anchor the evaporator coil. Further, front edge (20*a*) has a number of smaller holes (168) for fastening other sheet metal components thereto. Front edge also has a protruded portion (20*a*) for use as a hand-pull to help remove the chassis from the shell.

Figure 7C:
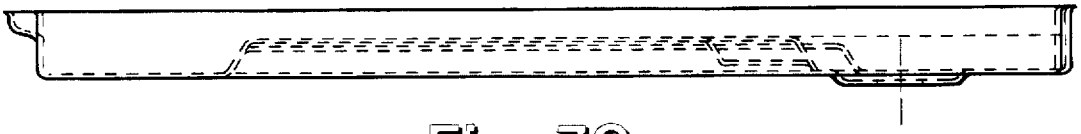
FIG. 7C is a right side view of the base pan.
Figure 7D:
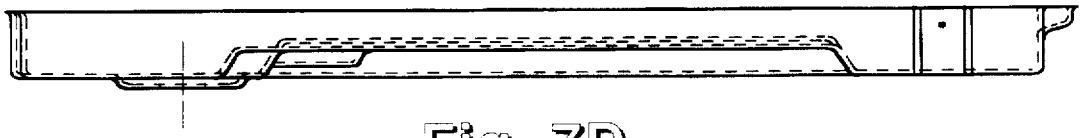
FIG. 7D is a left side view of the base pan.
Figure 7E:
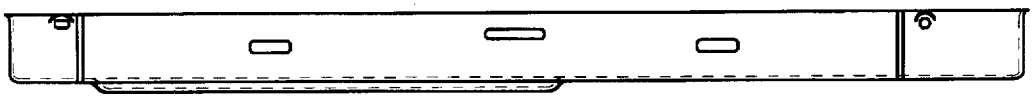
FIG. 7E is a rear elevational view of the base pan.

Turning to FIG. 7E, it is seen that rear edge (20*b*) has a slot (170*a*) and a hole (170*b*) near the ends thereof for the condenser coil attachment. Two slots (172) lie to either side of the center line of the rear edge for water overflow from the base pan. Central slot (174) is provided for a chassis hold down during shipping by acceptance of a flange formed on the back of the shell dimensioned for receipt into the slot.

Basically, applicants' floor (21) has two surfaces, upper surface (21*a*) and lower surface (21*b*) (see FIGS. 7C and 7D). Embossed regions, as more particularly set forth below, stand above upper surface (21*a*). Below lower surface (21*b*) is a trough (176) with a channel portion (176*a*) and a hole (176*b*) therein designed to catch and drain condensate from the condenser. An overall view, especially appreciated from the views illustrated in FIGS. 7A and 7C, shows base pan (20) having an elevated, centrally-located land (178) bordered at the front by an evaporator base (180), at the rear by a condenser base (182), and along the right side wall by side wall trough (184), the latter connecting the evaporator base (180) with the condenser base (182) to carry condensate. With side wall trough (184) communicating with evaporator base (180) and condenser base (182), water or condensate can reach the lowest point, here, channel (176). This will allow water or the condensate to escape collection on base pan (20) by removal through a hole (176*b*).

The primary means of condensate disposal is by fan blade slinger ring (41*a*) (see FIG. 1B) picking up condensate in the sump area defined by fan shroud clearance depression (190) and spraying it on the condenser coil for reevaporation.

Turning to FIGS. 7A through 7E, especially FIG. 7A, it is seen that land (178) is comprised primarily of upper surface (21*a*), but is trisected by embossment channels (186), these channels comprised of three arms (186*a*), (186*b*) and (186*c*). It is noted with reference to FIG. 7A that the effect of these embossments is to reduce the expanse of unbroken upper surface (21*a*). The effect of embossment channels (186*a*) through (186*c*) is to interfere with the vibration of upper surface (21*a*) of land (178). That is, vibration generated principally by the operation of the compressor and electric motor ultimately finds its way, at least in part, to the base pan to which it is mounted. By deforming the configuration of land (178) in an effort to decrease an otherwise flat expanse, surface flexing sympathetic with the motor vibration is dampened. Further dampening is produced by the use of motor mount embossment (188). It is seen how the use of embossment channels (186) divide land (178) into three portions, motor mount portion (178*a*), blower cage portion (178*b*), and compressor portion (178*c*). All three of these areas may be a source of vibration. For example, during cycling and operation of the compressor, some vibration would typically be transmitted to compressor portion (178*c*). Moreover, during operation of electric motor (36), blower (48) would typically transmit some vibration to blower cage portion (178*b*) while the operation of the motor would transmit some vibration through motor mount bracket (38) to motor mount portion (178*a*). However, the likelihood of constructive interference of base pan vibration from these three differently dimensioned sources is decreased through the use of embossments separating land (178) into separate components.

Land (178) is also provided with fan shroud clearance depression (190), concave (as viewed in FIGS. 7A and 7B) to allow clearance for fan shroud (42). Further, it is noted how both bulkhead (32) and side wall (32*b*), as well as motor mount (38), are mounted to land (178) on embossment channels (186), further helping isolate the transmission of vibration to land (178). Mounting points tend to be points at which vibration may be transmitted; the vibration may be decreased by mounting the structures in the embossment—which represents less surface area—in the land portions (178*a*) through (178*c*).

Figure 8:
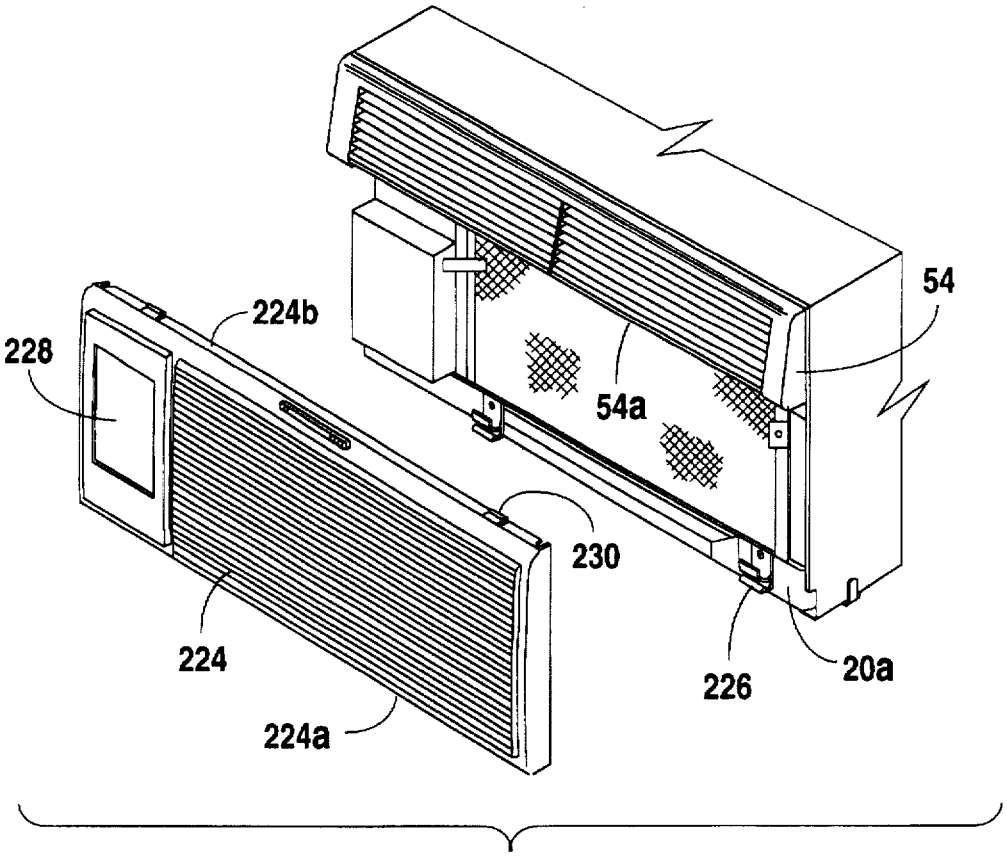
FIG. 8 is an isometric view of the front grill attachment to the air conditioning assembly.

FIG. 8 illustrates front grill (224) having lower lip (224*a*) and upper lip (224*b*), the lower lip for engaging clip (226) which is in turn attached to the front edge (20*a*) of base pan (20) in a manner set forth more fully below. Front grill (224) is seen to have cut-out (228) to allow access to the control panel and its buttons or touchpad. Tabs (230) along the upper edge of front grill (224) are designed to resiliently engage slots among the lower edge (54*a*) of air discharge plenum grill (54). In this manner, the front grill can be removed without the use of tools. Moreover, when removed, there are no exposed electrical components.

Figure 9:
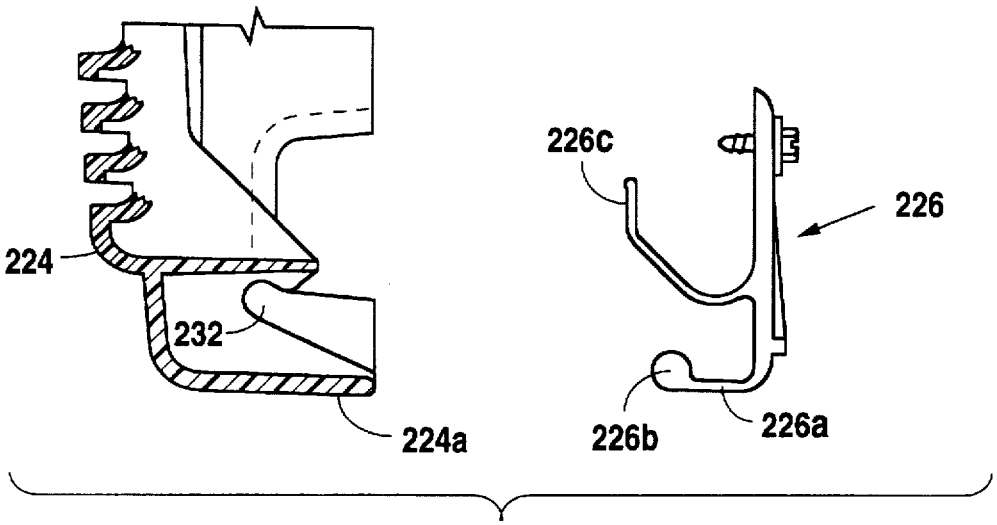
FIG. 9 is a side view showing attachment of the engaging clip to the front grill.
Figure 10A:
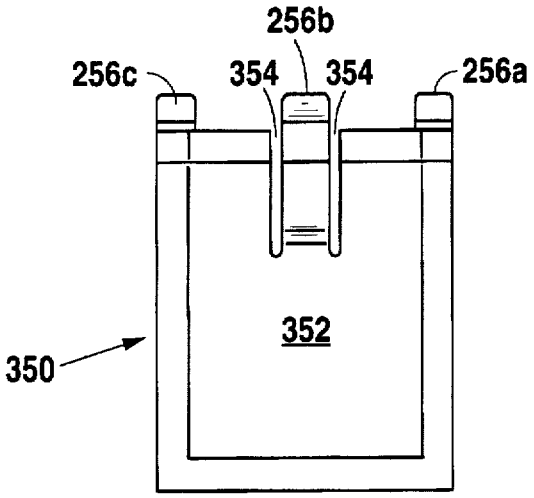
FIG. 10A is a top plan view of the guide blocks.
Figure 10B:
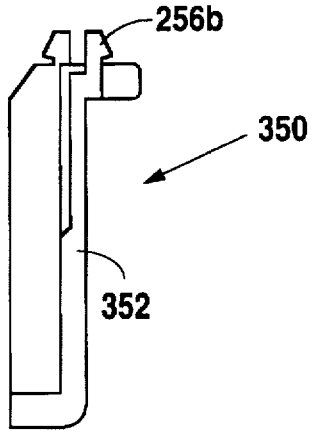
FIG. 10B is a left side elevational view of the guide blocks.
Figure 10C:
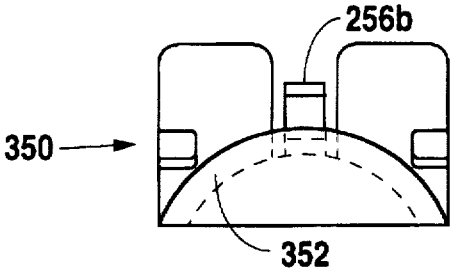
FIG. 10C is a front elevational view of the guide blocks.
Figure 10D:
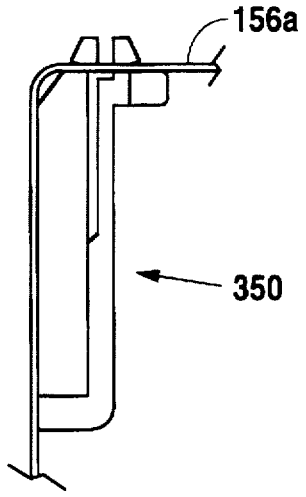
FIG. 10D is a detailed cutaway elevational view of the guide block engaged with the shell.
Figure 11:
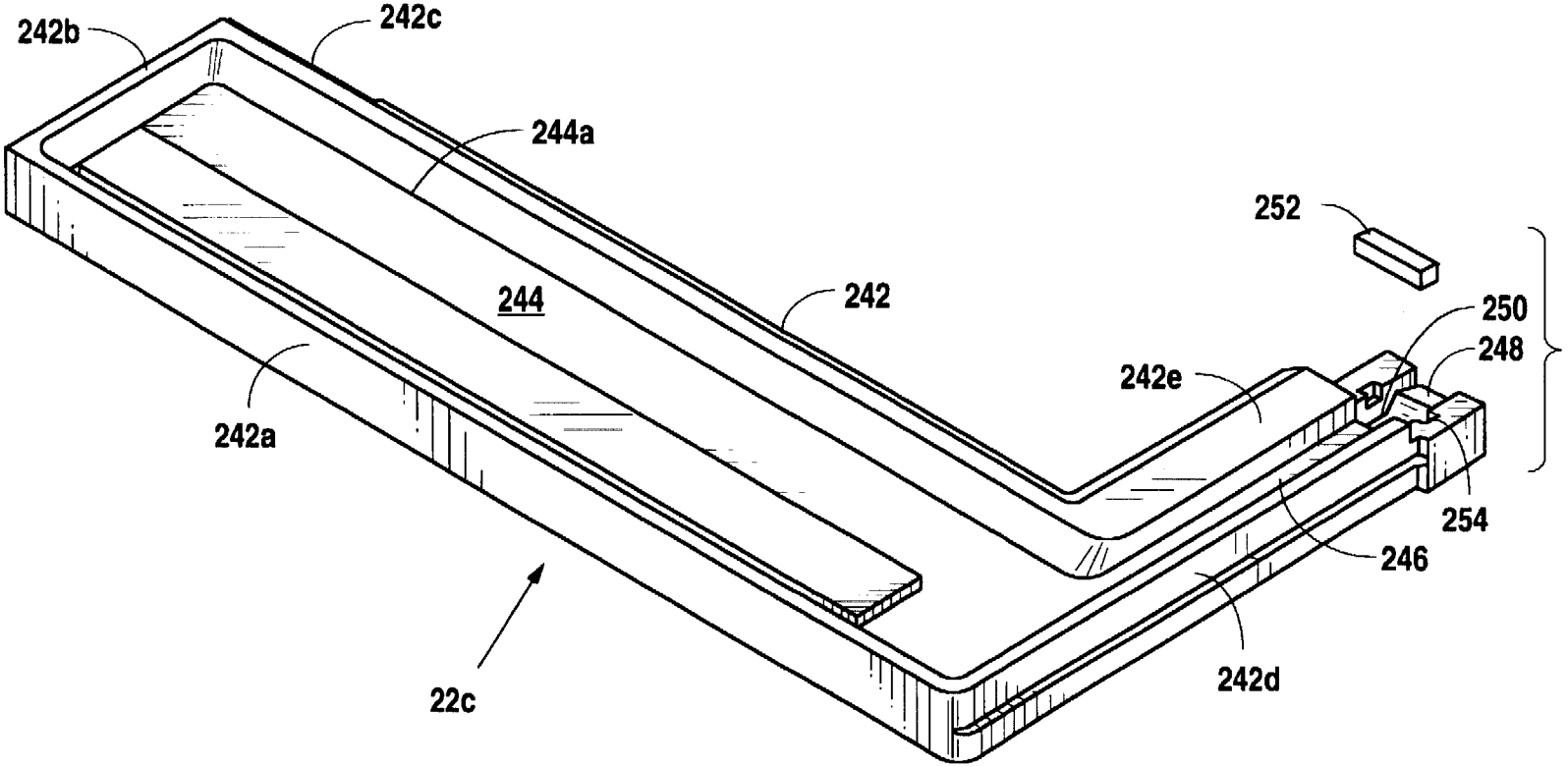
FIG. 11 is an isometric view of the drainpan.
Figure 12D:
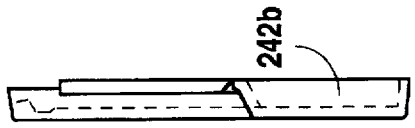
FIG. 12D is a left side view of the drainpan.
Figure 12C:
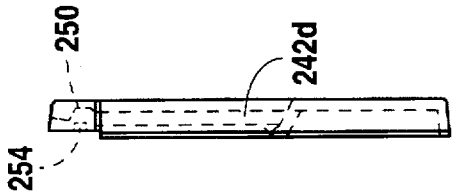
FIG. 12C is a right side view of the drainpan.
Figure 12A:
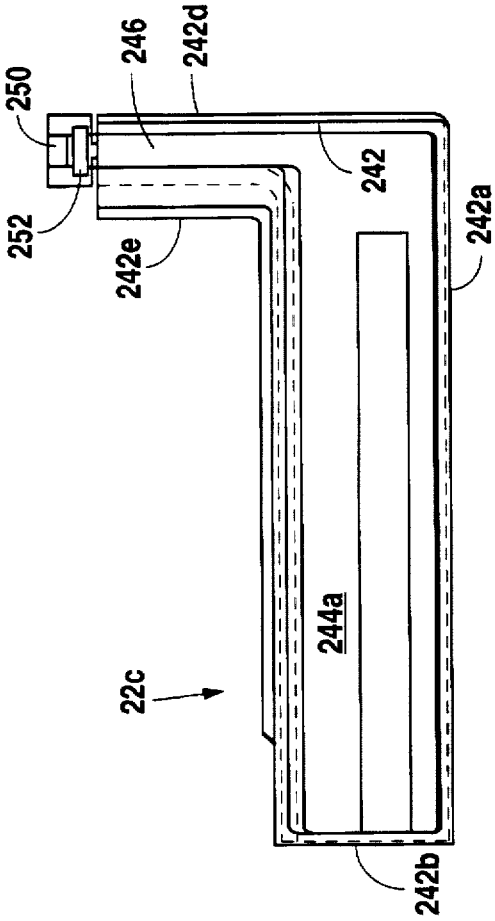
FIG. 12A is a top plan view of the drainpan.
Figure 12B:
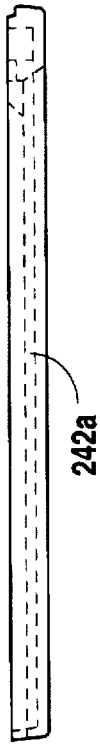
FIG. 12B is a front elevational view of the drainpan.

FIG. 9 illustrates the manner in which clips (226) engage lower edge (224*a*) of front grill (224). More specifically, it is seen that clips (226) have lower leg (226*a*) with knob (226*b*) on the removed end thereof. The knob and clips are designed to friction engage the slot (232) to hold the front grill in place. The action of the two clips along the lower edge of the front grill combined with the two tabs along the upper edge allow the grill to be held toollessly in place in a secure manner that overcomes the need for using screws or other fasteners typically known in the trade to mechanically fasten, through the use of screws or the like, the front grill to the remainder of the air conditioning assembly. Note that clip (226) also provides for a cord retainment member and guide means (226*c*) which allows an electrical cord to lay in the cup created across the front edge of the base pan.

FIGS. 10A through 10D illustrate the manner in which applicants' guide block (250), being made typically of plastic or TEFLON®, guides the insertion of the chassis, bearing the subassemblies, into the shell (156). Typically, there is one guide block on either side and it is inserted along rails on either side of the shell and oriented flush against side wall (156*a*). That is, guide block (250) has body (252) which is typically convex when viewed from the outside. It utilizes prongs (256*a*), (256*b*) and (256*c*), which resiliently engage slots in the rail. This assists both in slideably allowing the chassis to move through the shell and also helping align the shell with the chassis so that the front grill and the air discharge plenum grill are properly aligned with the remaining components of the modular air conditioning unit.

Thus, it is seen how applicants provide, in a modular room air conditioner, a number of novel and unique components.

More particularly, it is seen how applicants provide for a modular room air conditioner in which refrigeration subassemblies, air handling subassemblies, and control system subassemblies are separately assembled, and then secured to a base pan.

Additionally, it is seen how the base pan is uniquely contoured to accept the subassemblies and the components thereof in a fashion that is both stronger and quieter than disclosed in the prior art.

Further, it is seen that the air handling assembly has unique features which include toolless assembly of a strut-braced shroud as well as a unique rubber isolated motor mount system. Of the unique components of the air handling assembly include the unique construction of the exhaust air vent system and the manner in which it is constructed and fastened to the side wall of the bulkhead.

The modular control system includes the enclosure of all exposed electrical components within the control box itself and allowing the use of a heat/cool anticipator directly in the evaporator air stream.

The chassis of the modular air conditioner is retained in the exterior shell by means of a unique security strap. The front grill and air discharge plenum grill both toollessly engage the unit for ease of removal. A unique drain pan is provided for support of the evaporator on the base pan which cooperates with the base pan to effectively drain condensate from beneath the evaporator to the rear of the air conditioning unit.

FIGS. 11 and 12A through 12D illustrate various views of applicants' drain pan (22*c*). The drain pan rests on base pan (20) and provides support to the evaporator (22) (see also FIG. 1A). It functions to catch and retain liquid draining off the evaporator and to channel the liquid in a manner set forth more fully below. Thus, drain pan (22*c*) is seen to have outer walls (242) surrounding floor (244). Note how the front, rear and end walls, as well as part of wide wall (242*d*) define a basin dimensioned to accept the bottom of the evaporator and to enclose any condensate draining off the evaporator. More specifically, outer walls (242) include front wall (242*a*), end wall (242*b*), rear wall (242*c*) and two side walls (242*d*) and (242*e*). The two side walls define a trough (246) for carrying water out of the drain pan in a manner set forth more fully below. Water draining through trough (246) must pass through trap (248). Trap (248) includes depression (250) which has a floor below the level of trough (246). Dam (252) is located traverse to the longitudinal axis of trough (246) and centrally in depression (250) by means of notches (254). Thus, water draining from drain pan 22*c* must pass beneath dam (252). This will prevent any movement of debris floating on water from getting into the drain pan or from leaving the drain pan and prevent insects or the like from moving from the outside through the trough. It also prevents outside air pressure from adversely influencing the flow of condensate to the outside.

Figure 13:
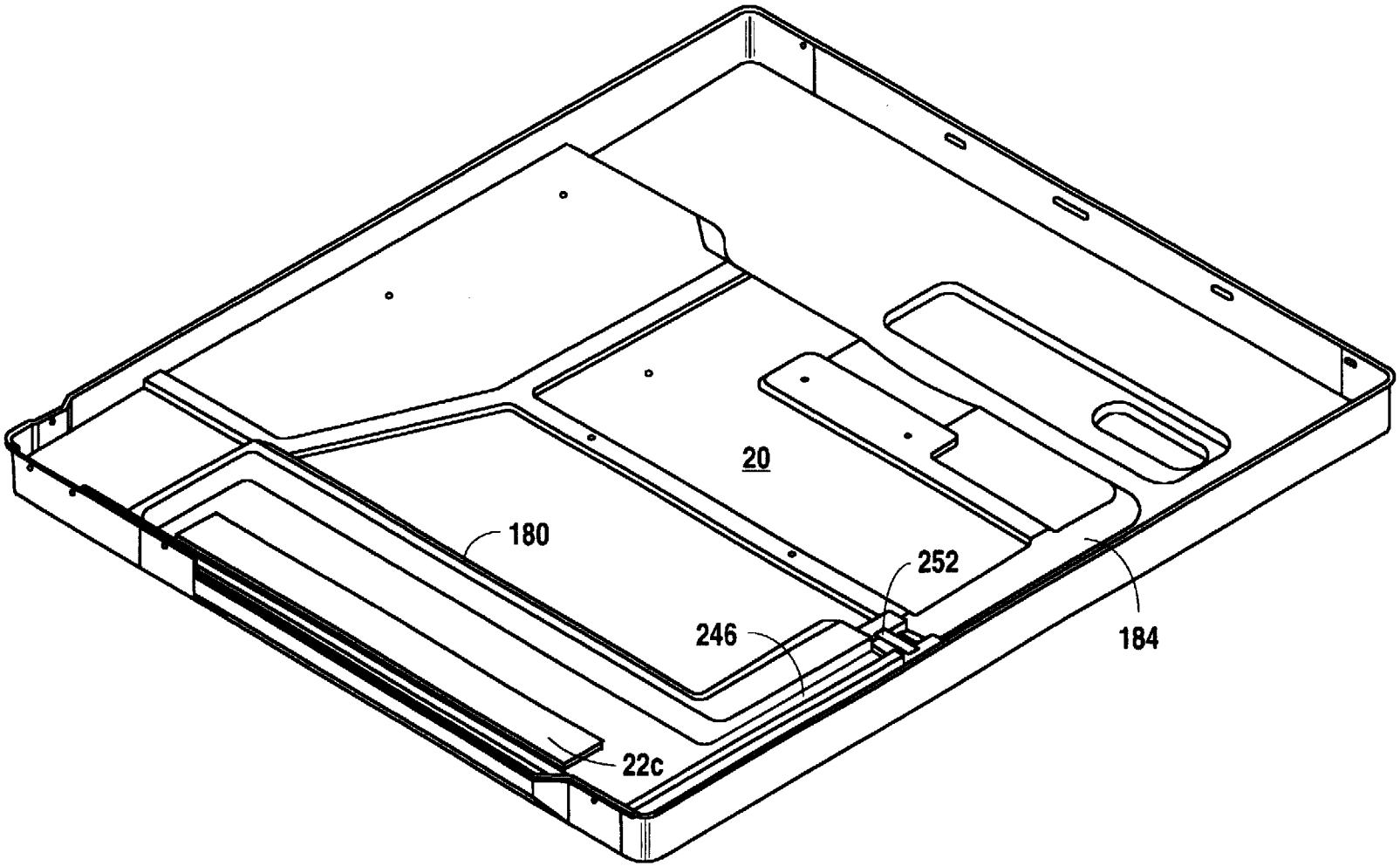
FIG. 13 is an isometric view of the basepan.

FIG. 13 illustrates the manner in which drain pan (22*c*) rests in base pan (20). More particularly, it is seen how the floor of the base pan is contoured with elevated areas located adjacent to rear wall (242*c*) and side wall (242*e*) to define evaporator base (180) (see FIG. 7A) dimensioned to receive the drain pan. It is further seen how trough (246) communicates with side wall trough (184) of base pan (20) to direct condensate to the rear of the base pan for elimination in the manner bet forth above with respect to FIGS. 7A through 7C.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use. As used in the preamble of the claims, "air conditioning unit" includes air conditioning units with or without heat pump or electric heating capabilities.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. The air conditioning unit comprising:

a refrigeration assembly including a generally rectangular base pan having upturned edges and a floor with a raised section, said base pan having mounted to an upper surface thereof a condenser, an evaporator, and a compressor;

an air handling assembly including a bulkhead, a scroll, a motor having an output shaft, a motor mount bracket for engaging the base pan of the refrigeration assembly, a fan, a blower engaging the output shaft of the motor, a fan shroud, and an air plenum assembly;

a control assembly including a control housing and a control panel;

said motor mount bracket including a first member adapted to receive therethrough one end of said output shaft of said motor for fastening directly to said raised section of said floor of said base pan; and the member of the motor mount bracket includes a recessed polygonal cup and the motor includes a polygonal-shaped rubber ring on the output shaft for a snug fit when inserted into the polygonal cup.

2. The air conditioning unit of claim 1, wherein the motor includes a circular rubber ring and the bulkhead includes a circular recessed cup portion for receiving the circular rubber ring therein and the output shaft therethrough.

3. The air conditioning unit comprising:

a refrigeration assembly a generally rectangular base pan with upturned edges and a floor having a recessed section, said base pan having mounted to an upper section thereof a condenser, an evaporator, and a compressor;

an air handling assembly having a bulkhead, a scroll, a motor having an output shaft, a motor mount bracket for engaging the base pan of the refrigeration assembly, a fan, a blower engaging said output shaft of said motor, a fan shroud, and air plenum assembly;

a control assembly having a control housing and a control panel; and the motor mount bracket further includes a first member adapted to receive and engage one end of the output shaft, the first member capable of being secured to the base pan and wherein the motor mount bracket further includes a second member, integral with the first member, the second member capable of being secured to the bulkhead.

4. The air conditioning unit of claim 3, wherein the first member of the motor mount bracket includes a recessed polygonal cup and the motor includes a polygonal-shaped rubber ring for a snug fit when inserted into the polygonal cup.

5. The air conditioning unit of claim 4, wherein the motor includes a circular rubber ring and the bulkhead includes a circular recessed cup portion for receiving the circular rubber ring therein.

6. The air conditioning unit comprising:

a refrigeration assembly having a generally rectangular base pan with upturned edges and a floor having a raised section, said base pan having mounted to an upper surface thereof a condenser, an evaporator, and a compressor;

an air handling assembly having a bulkhead, a scroll, a motor having an output shaft, a motor mount bracket for engaging the base pan of the refrigeration assembly, a fan, a blower engaging said output shaft of said motor, a fan scroll, and an air plenum assembly;

a control assembly having a control housing and a control panel; and the air handling assembly includes a means downstream of the blower-driven air flow for decreasing eddying of the air flow during operation of the blower.

7. The air conditioning unit of claim 6, wherein the eddying decrease means is a baffle in front of an air discharge grill of the room air conditioner.

8. The air conditioning unit comprising:

a refrigeration assembly having a generally rectangular base pan with upturned edges and a floor having a raised section, said base pan having mounted to an upper surface thereof a condenser, an evaporator, and a compressor;

an air handling assembly having a bulkhead, a scroll, a motor having an output shaft, a motor mount bracket for engaging the base pan of the refrigeration assembly, a fan, a blower engaging said output shaft of said motor, a fan scroll, and an air plenum assembly;

a control assembly having a control housing and a control panel; and the raised section of the floor of the base pan of said refrigeration assembly includes embossments for reinforcement and noise reduction.

9. The air conditioning unit of claim 8, wherein the embossments of the raised section of the floor of the base pan of said refrigeration assembly includes means to attach the bulkhead thereto.

10. The air conditioning unit of claim 9, wherein the embossments of the raised section of the floor of the base pan of said refrigeration assembly includes means to attach the bulkhead thereto and includes means to attach the motor mount bracket thereto.

11. The air conditioning unit of claim 8, wherein the embossments separate said raised section into an area for mounting the compressor thereto.

12. The air conditioning unit of claim 8, wherein the embossments separate said raised section into an area for mounting the motor mount bracket thereto.

13. The air conditioning unit of claim 8, wherein the embossments separate said raised section into an area underlying the blower.

14. The air conditioning unit of claim 8, wherein the embossments separate said raised section into an area for mounting the compressor thereto, for mounting the motor mount bracket thereto, and into an area underlying the blower.

15. The air conditioning unit comprising:

a refrigeration assembly having a generally rectangular base pan with upturned edges and a floor having a raised section, said base pan having mounted to an upper surface thereof a condenser, an evaporator, and a compressor:

an air handling assembly having a bulkhead, a scroll, a motor having an output shaft, a motor mount bracket for engaging the base pan of the refrigeration assembly, a fan, a blower engaging said output shaft of said motor, a fan scroll, and an air plenum assembly:

a control assembly having a control housing and a control panel; and the upturned edges of the base pan define a flanged perimeter.

16. The air conditioning unit of claim 1, wherein the base pan includes curved areas at the junction of the edges and the floor, the curved areas defining radii of curvature at least 6 times the thickness of the base pan forming material.

17. The air conditioning unit comprising:

a refrigeration assembly having a generally rectangular base pan with upturned edges and a floor having a raised section, said base pan having mounted to an upper surface thereof a condenser, an evaporator, and a compressor;

an air handling assembly having a bulkhead, a scroll, a motor having an output shaft, a motor mount bracket for engaging the base pan of the refrigeration assembly, a fan, a blower engaging said output shaft of said motor, a fan scroll, and an air plenum assembly;

a control assembly having a control housing and a control panel; and a shell, said shell having a front opening and a rear opening, the shell capable of receipt of the base pan when the base pan has the evaporator, the condenser, said air handling assembly, said plenum and said control assembly mounted thereto.

18. The air conditioning unit of claim 17, further including means to guide the insertion of the base pan into said shell, said guide means includes a multiplicity of plastic blocks.

19. The air conditioning unit of claim 18 further including a security means, inaccessible from the rear opening, engaging the shell and the base pan to help prevent the removal of the chassis from the rear opening of the shell and to restrict the movement of the chassis inside the shell.

20. The air conditioning unit of claim 1, wherein the control panel of the control assembly includes a fully electronic control face having a touchpad control means.

21. The air conditioning unit of claim 1, wherein the control panel of the control assembly includes a multiplicity of knobs and said control assembly further includes a heat/cool anticipator in operative engagement with the control panel.

22. The air conditioning unit comprising:

a refrigeration assembly having a generally rectangular base pan with upturned edges and a floor having a raised section, said base pan having mounted to an upper surface thereof a condenser, an evaporator, and a compressor;

an air handling assembly having a bulkhead, a scroll, a motor having an output shaft, a motor mount bracket for engaging the base pan of the refrigeration assembly, a fan, a blower engaging said output shaft of said motor, a fan scroll, and an air plenum assembly;

a control assembly having a control housing and a control panel;

said control panel of said control assembly includes a multiplicity of knobs and said control assembly further includes a heat/cool anticipator in operative engagement with the control panel; and the heat/cool anticipator of said control assembly further includes a resistor and a sensor, mounted and in close proximity to one another, the resistor having leads extending therefrom, the resistor and the leads being encapsulated in an electrically insulative medium.

23. An air conditioning unit comprising:

a refrigeration assembly, said refrigeration assembly including a generally rectangular base pan having upturned edges and a floor having a raised section, the base pan having mounted thereon a condenser, an evaporator, and a compressor;

an air handling assembly, said air handling assembly including a bulkhead, a scroll, a motor having an output shaft, a motor mount bracket, a fan, a blower engaging the output shaft of the motor, a fan shroud, and an air plenum assembly;

a control assembly, said control assembly including a control housing and a control panel;

wherein said air handling assembly includes a front grill and base pan mounting means, the front grill mounted vertically to the front edge of the base pan without the use of tools; and wherein the front grill mounting means further includes an electric power cord guide means for engaging an electric power cord.

24. An air conditioning unit comprising:

a refrigeration assembly, said refrigeration assembly including a generally rectangular base pan having upturned edges and a floor having a raised section, the base pan having mounted thereon a condenser, an evaporator, and a compressor;

an air handling assembly, said air handling assembly including a bulkhead, a scroll, a motor having an output shaft, a motor mount bracket, a fan, a blower engaging the output shaft of the motor, a fan shroud, and an air plenum assembly;

a control assembly, said control assembly including a control housing and a control panel;

wherein the air handling assembly further includes struts, the struts for mounting the shroud to the bulkhead without the use of tools.

25. An air conditioning unit comprising:

a refrigeration assembly, said refrigeration assembly including a generally rectangular base pan having upturned edges and a floor having a raised section, the base pan having mounted thereon a condenser, an evaporator, and a compressor;

an air handling assembly, said air handling assembly including a bulkhead, a scroll, a motor having an output shaft, a motor mount bracket, a fan, a blower engaging the output shaft of the motor, a fan shroud, and an air plenum assembly;

a control assembly, said control assembly including a control housing and a control panel;

wherein the scroll is formed from one piece of insulation-type material, the scroll having an outer surface shaped to flush fit against the bulkhead and having an inner surface defining a generally cylindrical blower cavity, the inner surface terminating at walls defining a port, the port for the passage of air outward from the blower cavity therethrough during the operation of the motor, the scroll further having a fresh air inlet port and an exhaust port through the walls thereof.

26. An air conditioning unit comprising:

a refrigeration assembly, said refrigeration assembly including a generally rectangular base pan having upturned edges and a floor having a raised section, the base pan having mounted thereto a condenser, an evaporator, and a compressor;

an air handling assembly, said air handling assembly including a bulkhead, a scroll, a motor having an output shaft, a motor mount bracket, a fan, a blower engaging the output shaft of the motor, a fan shroud, and an air plenum assembly; and a control assembly, said control assembly including a control housing and a control panel;

wherein the air handling assembly includes means downstream of the blower-driven air flow for decreasing eddying of the air flow during operation of the blower.

27. An air conditioning unit comprising:

a refrigeration assembly, said refrigeration assembly including a generally rectangular base pan having upturned edges and a floor having a raised section, the base pan having mounted thereto a condenser, an evaporator, and a compressor;

an air handling assembly, said air handling assembly including a bulkhead, a scroll, a motor having an output shaft, a motor mount bracket, a fan, a blower engaging the output shaft of the motor, a fan shroud, and an air plenum assembly;

a control assembly, said control assembly including a control housing and a control panel;

further including a shell, said shell having a front opening and a rear opening, the shell capable of receipt of the base pan when the base pan has the evaporator, the condenser, the compressor, said air handling assembly, said plenum, and said control assembly mounted thereto; and further including means to guide the insertion of the base pan into said shell.

* * * * *